US011402125B1

(12) United States Patent
Jones

(10) Patent No.: US 11,402,125 B1
(45) Date of Patent: Aug. 2, 2022

(54) ENHANCED HEATING SYSTEM

(71) Applicant: JozieV, Inc., Seattle, WA (US)

(72) Inventor: Joseph Charles Jones, Seattle, WA (US)

(73) Assignee: JozieV, Inc., Seattle, WA (US)

( * ) Notice: Subject to any disclaimer, the term of this patent is extended or adjusted under 35 U.S.C. 154(b) by 0 days.

(21) Appl. No.: 17/683,337

(22) Filed: Feb. 28, 2022

Related U.S. Application Data

(60) Provisional application No. 63/154,584, filed on Feb. 26, 2021.

(51) Int. Cl.
*F24H 3/02* (2022.01)
*F24H 3/00* (2022.01)

(52) U.S. Cl.
CPC ..... *F24H 3/022* (2013.01); *F24H 3/002* (2013.01); *F24H 2240/00* (2013.01)

(58) Field of Classification Search
None
See application file for complete search history.

(56) References Cited

U.S. PATENT DOCUMENTS 1,286,429 A * 12/1918 Shindel ..... H01L 35/00 126/374.1
1,738,222 A * 12/1929 Baker et al. ..... F24B 5/04 126/68
2,386,462 A * 10/1945 Hess ..... B64D 13/08 260/665 R
2,501,627 A * 3/1950 Findley ..... F23N 5/10 126/116 A
3,150,656 A * 9/1964 Huber ..... B60H 1/2212 236/11
3,620,205 A * 11/1971 Vial ..... F24H 3/065 126/116 A
3,759,244 A * 9/1973 Konet ..... F24H 3/04 431/255
4,353,411 A * 10/1982 Harter ..... F24F 13/20 52/302.1
4,843,273 A * 6/1989 Dammers ..... B60H 1/00364 219/202
4,942,863 A * 7/1990 Chou ..... F24H 9/18 126/110 E
5,450,869 A * 9/1995 Brittain ..... H01L 35/00 136/211
5,495,829 A * 3/1996 Jayaraman ..... F24H 1/205 126/110 E
5,544,488 A * 8/1996 Reid ..... F04D 25/02 136/204
2004/0237541 A1* 12/2004 Murphy ..... B60H 1/00457 62/3.61
2008/0260364 A1* 10/2008 Vandrak ..... F24H 3/0488 392/365
2011/0265779 A1* 11/2011 Vandrak ..... F24H 9/06 126/93

(Continued)

*Primary Examiner* — Thor S Campbell
(74) *Attorney, Agent, or Firm* — Grandview Law

(57) ABSTRACT

Systems and methods are involved for an enhanced heating system includes (I) an enclosure, (II) a burner, (III) an electrically-powered fan, (IV) a wall partition, and (V) a thermoelectric generator to generate electrical power for the electrically-powered fan. In addition, other aspects are described in the claims, drawings, and text forming a part of the present disclosure.

25 Claims, 39 Drawing Sheets

(56) References Cited

U.S. PATENT DOCUMENTS

| | | | | |
|---|---|---|---|---|
| 2013/0008423 | A1* | 1/2013 | Noble | F24H 3/0488<br>432/29 |
| 2021/0210668 | A1* | 7/2021 | Abbasi | F23D 14/02 |
| 2022/0109407 | A1* | 4/2022 | Martin | H03F 3/602 |

* cited by examiner

ENHANCED HEATING SYSTEM

SUMMARY

In one or more aspects, a system for heating can include (I) an enclosure; (II) at least one burner to burn fuel to generate heat, the at least one burner positioned within the enclosure; (III) at least one electrically-powered fan positioned within the enclosure to push out from the fan an upward-vertically-directed airstream within the enclosure; (IV) a wall partition positioned within the enclosure, the wall partition including at least a first side and at least a second side, (a) the at least one electrically powered fan being positioned on the first side of the wall partition, and (b) the at least one burner being positioned on the second side of the wall partition; and (V) at least one thermoelectric generator to generate electrical power for the at least one electrically-powered fan, the at least one thermoelectric generator including (a) at least one cool-side heat exchanger portion being positioned on the first side of the wall partition, (b) at least one hot-side heat exchanger portion being positioned on the second side of the wall partition above the at least one burner, and (c) a thermoelectric conversion portion to generate electricity to at least in part power the at least one electrically-powered fan based at least in part upon a temperature difference between the cool-side heat exchanger portion and the hot-side heat exchanger portion. Further including a multi-directional air diverter, wherein (A) the enclosure includes at least a first vertically-oriented vent portion facing in a first horizontal direction and a second vertically-oriented vent portion facing in a second horizontal direction dissimilar to the first horizontal direction, and (B) the multi-directional air diverter (1) being positioned vertically above the electrically powered fan, (2) being positioned above the wall partition, (3) including a first portion being sized, positioned, and shaped to divert at least a first portion of the upward-vertically directed airstream to be outwardly-horizontally directed over the wall partition, and through the first vertically-oriented vent portion, and (4) including a second portion being sized, positioned, and shaped to divert at least a second portion of the upward-vertically directed airstream to be outwardly-horizontally directed over the wall partition, and through the second vertically-oriented vent portion. Further including a multi-directional airflow diverter positioned above the electrically powered fan, the multi-directional airflow diverter positioned, sized, and shaped to divert the upward-vertically-directed airstream into four horizontally-orthogonally-differently-directed airstreams. Wherein the multi-directional air diverter has a downward pointing pyramidal shape. Wherein (a) the at least one cool-side heat exchanger portion of the at least one thermoelectric generator being sized and shaped with sufficient number of fins to dissipate heat to at least one first air mass from the at least one thermoelectric generator to produce a first cooler temperature within a first portion of the at least one thermoelectric generator, (b) the at least one hot-side heat exchanger portion of the at least one thermoelectric generator being sized and shaped with sufficient number of fins to absorb heat from at least one second air mass to produce a second hotter temperature within a second portion of the thermoelectric generator, the second hotter temperature being greater than the first cooler temperature for a positive temperature difference of the first cooler temperature subtracted from the second hotter temperature, and (c) a thermoelectric conversion portion to generate electricity based upon the positive temperature difference. Wherein the at least one thermoelectric generator being at least one Seebeck generator. Wherein the wall partition being a cylindrical structure including an and an exterior curvilinear wall surface, the first side of the wall partition being the interior curvilinear wall surface and the second side of the wall partition being the exterior curvilinear wall surface. Wherein the burner being a ring burner, the wall partition as the cylindrical structure being encircled by the ring burner. Wherein the enclosure includes four substantially vertical sides, the four substantially vertical sides including at least one window-paned side, the at least one window-paned side including a vented-double-window-paned glass portion. Wherein the vented-double-window-window-paned glass portion includes an interior window pane, an exterior window pane, and a gap space therebetween, the gap space including a lower aperture positioned, sized, and shaped to allow for passage of air into the gap space and an upper aperture positioned, sized, and shaped to allow passage of air out of the gap space. Wherein the lower aperture and the upper aperture are positioned, sized, and shaped to allow for sufficient passage of air into and out of the gap space to maintain a temperature on the exterior surface of the exterior window pane at or below 120 F while the burner is burning fuel. Wherein at the enclosure includes at least one post, and at least one of the at least one window-paned side being coupled to at least one post as a door. Wherein the at least one window-paned side includes four window-paned sides. Further including an elevated-horizontally-oriented baseplate, the baseplate including at least one aperture, the baseplate supporting at least in part the enclosure wherein air is allowed to entered into the enclosure through the at least one aperture. Wherein the at least one cool-side heat exchanger portion of the thermoelectric generator being positioned above the at least one electrically-powered fan. Wherein the at least one electrically-powered fan including at least one vertical-axis fan blade. Wherein the fuel being propane-based fuel.

In one or more aspects, a system for heating can include (I) an enclosure having at least one vertical exhaust vent facing horizontally outward from the enclosure; (II) at least one electrically-powered fan positioned within the enclosure to draw a first vertical airstream from the enclosure in an upward-vertical direction and to push out air from the fan in a second horizontally-directed airstream within the enclosure to be exhausted through the at least one vertical exhaust vent; (III) at least one burner to burn fuel to generate heat, the at least one burner being positioned under at least a portion of the second horizontally-directed airstream; (IV) a wall partition positioned within the enclosure, the wall partition including at least a first side and at least a second side, (a) the first vertical airstream being positioned on the first side of the wall partition, and (b) the at least one burner being positioned on the second side of the wall partition; and (V) at least one thermoelectric generator to generate electrical power for the at least one electrically-powered fan, the at least one thermoelectric generator including (a) at least one cool-side heat exchanger portion being positioned on the first side of the wall partition, (b) at least one hot-side heat exchanger portion being positioned on the second side of the wall partition above the at least one burner, and (c) a thermoelectric conversion portion to generate electricity to at least in part power the at least one electrically-powered fan based at least in part upon a positive temperature difference between the cool-side heat exchanger portion and the hot-side heat exchanger portion. Wherein (a) the at least one cool-side heat exchanger portion of the at least one thermoelectric generator being sized and shaped with sufficient number of fins to dissipate heat to at least one first air mass from the at least one thermoelectric generator to produce a first cooler temperature within a first portion of the at least one thermoelectric generator, (b) the at least one hot-side heat exchanger portion of the at least one thermoelectric generator being sized and shaped with sufficient number of fins to absorb heat from at least one second air mass to produce a second hotter temperature within a second portion of the thermoelectric generator, the second hotter temperature being greater than the first cooler temperature for a positive temperature difference of the first cooler temperature subtracted from the second hotter temperature, and (c) a thermoelectric conversion portion to generate electricity based upon the positive temperature difference. Wherein the at least one thermoelectric generator being at least one Seebeck generator. Wherein the enclosure has a doubled-window-paned side, the burner being an elongated burner adjacently positioned along the window-paned side of the enclosure. Wherein the enclosure includes at least one window-paned side including a vented-double-window-paned glass portion being positioned under at least a portion of the second horizontally-directed airstream. Wherein the vented-double-window-paned glass portion includes an interior window pane, an exterior window pane, and a gap space therebetween, the gap space including a lower aperture positioned, sized, and shaped to allow for passage of air into the gap space and an upper aperture positioned, sized, and shaped to allow passage of air out of the gap space. Wherein the lower aperture and the upper aperture are positioned, sized, and shaped to allow for sufficient passage of air into and out of the gap space to maintain a temperature on the exterior surface of the exterior window pane at or below 120 F while the burner is burning fuel. Further including an elevated-horizontally-oriented baseplate, the baseplate including at least one aperture, the baseplate supporting at least in part the enclosure wherein air is allowed to entered into the enclosure through the at least one aperture. Wherein the at least one cool-side heat exchanger portion of the thermoelectric generator being positioned at a level below the level of the at least one electrically-powered fan. Wherein the at least one electrically-powered fan including at least one horizontal-axis fan blade. Further comprising a propane bottle being contained within the enclosure and wherein the fuel burned by the at least one burner is propane.

In one or more aspects, a method can include providing a thermoelectric generator Seebeck device including a hot-side heat exchanger and a cool-side heat exchanger;

providing an electrical fan; electrically connecting electrical output of the thermoelectric generator Seebeck device to the electrical fan; providing a burner;

providing a wall to partition a first space from a second space; positioning the electrical fan in the first space; positioning the burner in the second space; positioning the hot-side heat exchanger of the thermoelectric generator Seebeck device in the second space above the burner; positioning the cool-side heat exchanger of the thermoelectric generator Seebeck device in the first space; burning fuel with the burner; providing electricity to the electrical fan from the thermoelectric generator Seebeck device to provide the electrical fan as an electrified fan; and moving air with the electrified fan in the first space past the cool-side heat exchanger of the cooling fins. Further comprising adjusting fan speed of the electrical fan by adjusting rate of fuel being burned by the burner.

In addition to the foregoing, other aspects are described in the claims, drawings, and text forming a part of the disclosure set forth herein. Various other aspects are set forth and described in the teachings such as text (e.g., claims and/or detailed description) and/or drawings of the present disclosure. Other aspects, features, and advantages of the devices and/or processes and/or other subject matter described herein will become apparent in the teachings set forth herein.

BRIEF DESCRIPTION OF THE FIGURES

For a more complete understanding of implementations, reference now is made to the following descriptions taken in connection with the accompanying drawings. The use of the same symbols in different drawings typically indicates similar or identical items, unless context dictates otherwise.

With reference now to the figures, shown are one or more examples of an enhanced heating systems, articles of manufacture, compositions of matter for same that may provide context, for instance, in introducing one or more processes and/or devices described herein.

DETAILED DESCRIPTION

Figure 1:
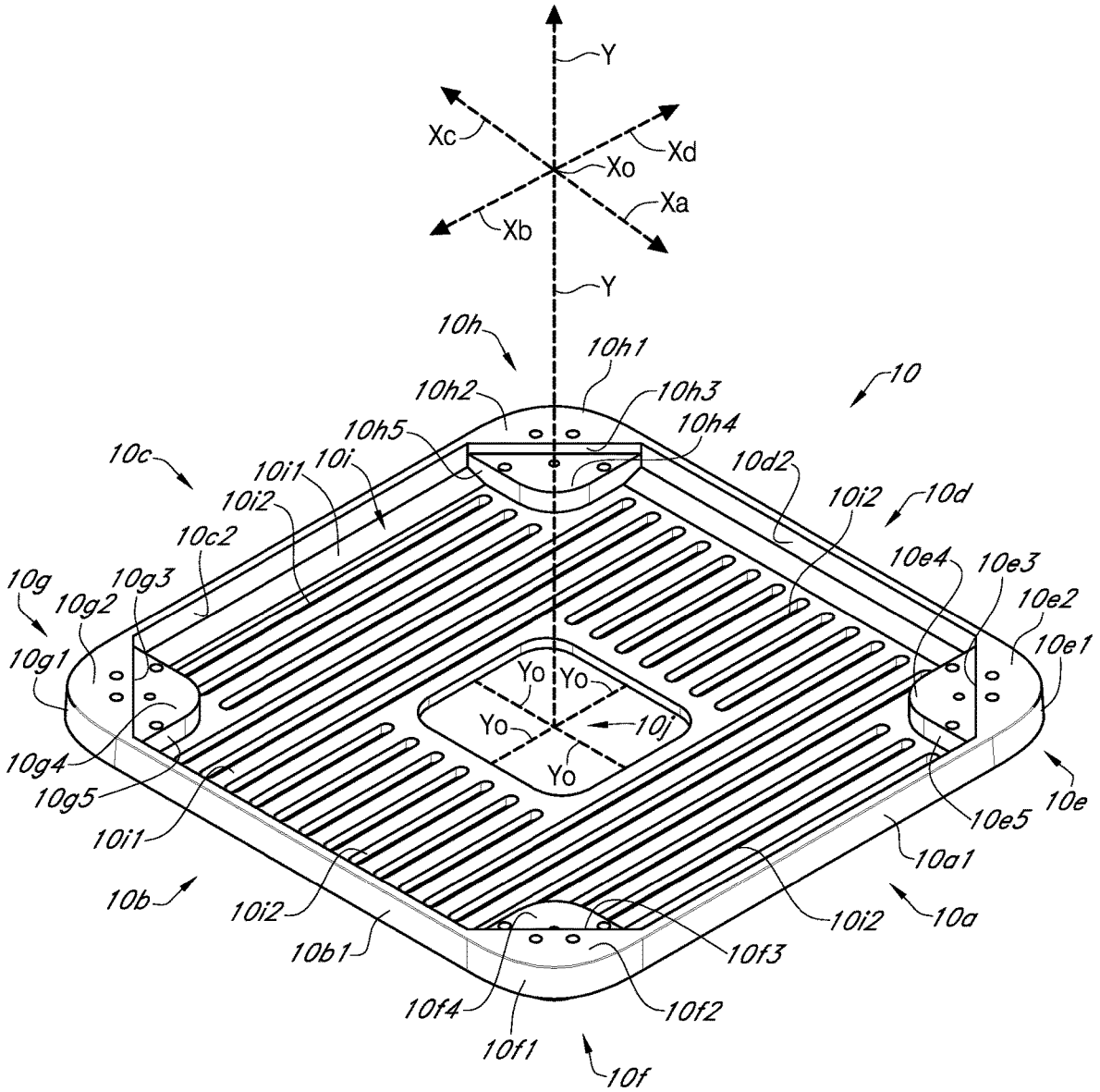
FIG. 1 is a perspective view showing aspects of a first implementation of an enhanced heating system including aspects of baseplate assembly.

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here.

Turning to FIG. 1, depicted therein is a perspective view showing aspects of a first implementation of enhanced heater system 28 (e.g. see, FIG. 12) including aspects of baseplate assembly 10 and depicted with use of horizontal axis Xa, horizontal axis Xb, horizontal axis Xc, horizontal axis Xd, origin of horizontal axes Xo, vertical axis Y, and origin of vertical axis Yo.

In implementations, baseplate assembly 10 is shown to include side portion l0*a* side portion 10*b*, side portion 10*c*, side portion 10*d*, corner portion 10*e*, corner portion 10*f*, corner portion 10*g*, corner portion 10*h*, horizontal plate member 10*i*, and central aperture 10*j*. In implementations, side portion l0*a* is shown to include exterior vertical surface 10*a*1. In implementations, side portion 10*b* is shown to include exterior vertical surface 10*b*1. In implementations, side portion 10*c* is shown to include interior vertical surface 10*c*2. In implementations, side portion 10*d* is shown to include interior vertical surface 10*d*2. In implementations, corner portion 10*e* is shown to include exterior vertical surface 10*e*1, upper-level horizontal surface 10*e*2, upper vertical interior surface 10*e*3, mid-level horizontal surface 10*e*4, and lower vertical interior surface 10*e*5. In implementations, corner portion 10*f* is shown to include exterior vertical surface 10*f*1, upper-level horizontal surface 10*f*2, upper vertical interior surface 10*f*3, and mid-level horizontal surface 10*f*4. In implementations, corner portion l0*g* is shown to include exterior vertical surface l0*g*1, upper-level horizontal surface 10*g*2, upper vertical interior surface 10*g*3, mid-level horizontal surface 10*g*4, and lower vertical interior surface 10*g*5. In implementations, corner portion 10*h* is shown to include exterior vertical surface l0*h*1, upper-level horizontal surface 10*h*2, upper vertical interior surface 10*h*3, mid-level horizontal surface 10*h*4, and lower vertical interior surface 10*h*5. In implementations, horizontal plate member 10*i* is shown to include plate member surface 10*i*1, elongated aperture 10*i*2. In implementations, corner portion 10*h* is so constructed to allow for sufficient airflow into.

Figure 2:
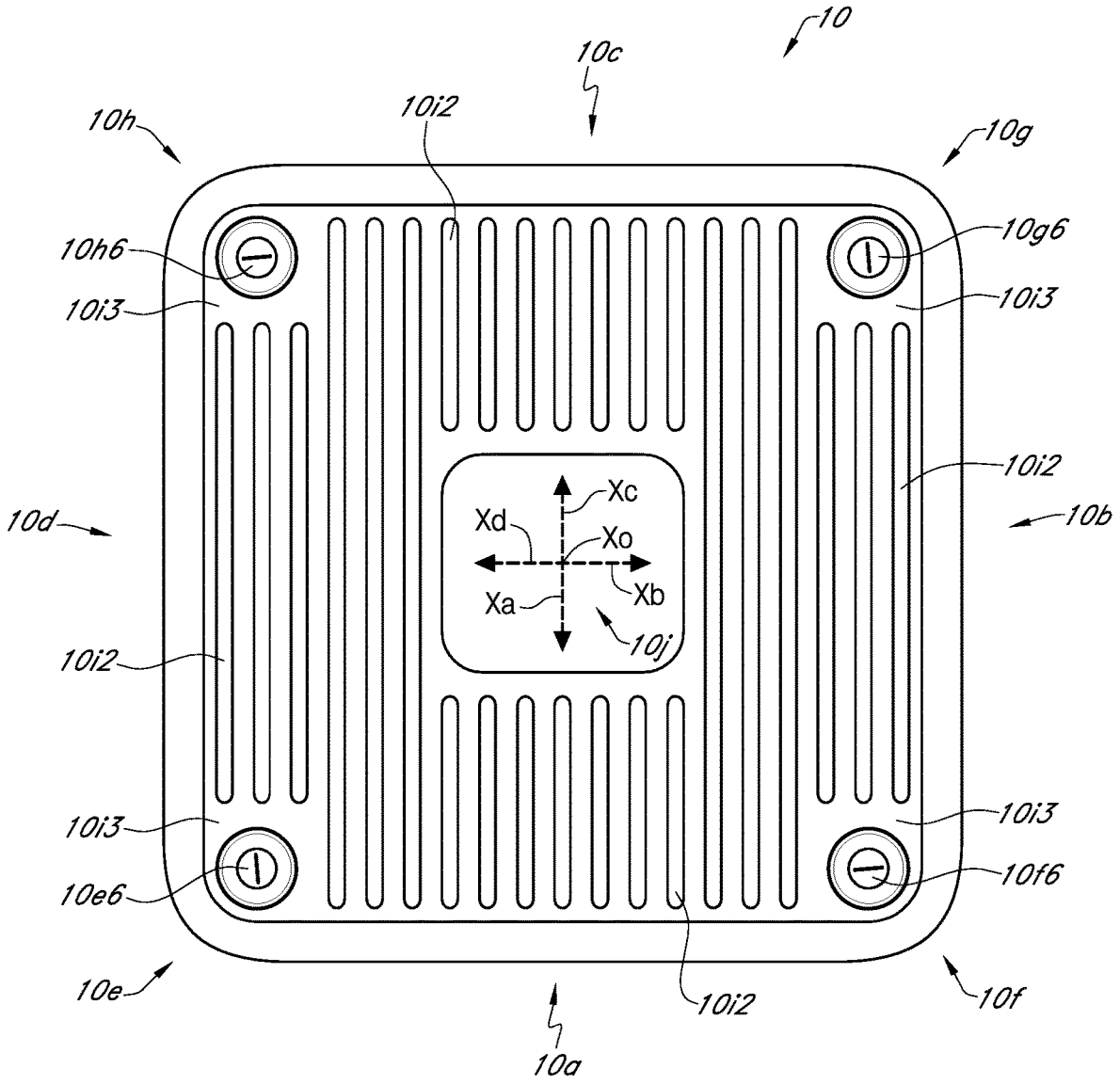
FIG. 2 is a bottom plan view showing aspects of the first implementation of the enhanced heating system including aspects of baseplate assembly.

Turning to FIG. 2, depicted therein is a bottom plan view showing aspects of the first implementation of the enhanced heater system 28 (e.g. see, FIG. 12) including aspects of baseplate assembly 10.

In implementations, baseplate assembly 10 is shown to include under surface 10*i*3, which is included in horizontal plate member 10*i* (see FIG. 1). In implementations, baseplate assembly 10, is shown in FIG. 2 to include foot member 10*e*6, which is included in corner portion 10*e* (see FIG. 1). In implementations, baseplate assembly 10, is shown in FIG. 2 to include foot member 10*f*6, which is included in corner portion 10*f* (see FIG. 1). In implementations, baseplate assembly 10, is shown in FIG. 2 to include foot member 10*g*6, which is included in corner portion 10*g* (see FIG. 1). In implementations, baseplate assembly 10 is shown in FIG. 2 to include foot member 10*h*6, which is included in corner portion 10*h* (see FIG. 1).

Figure 3:
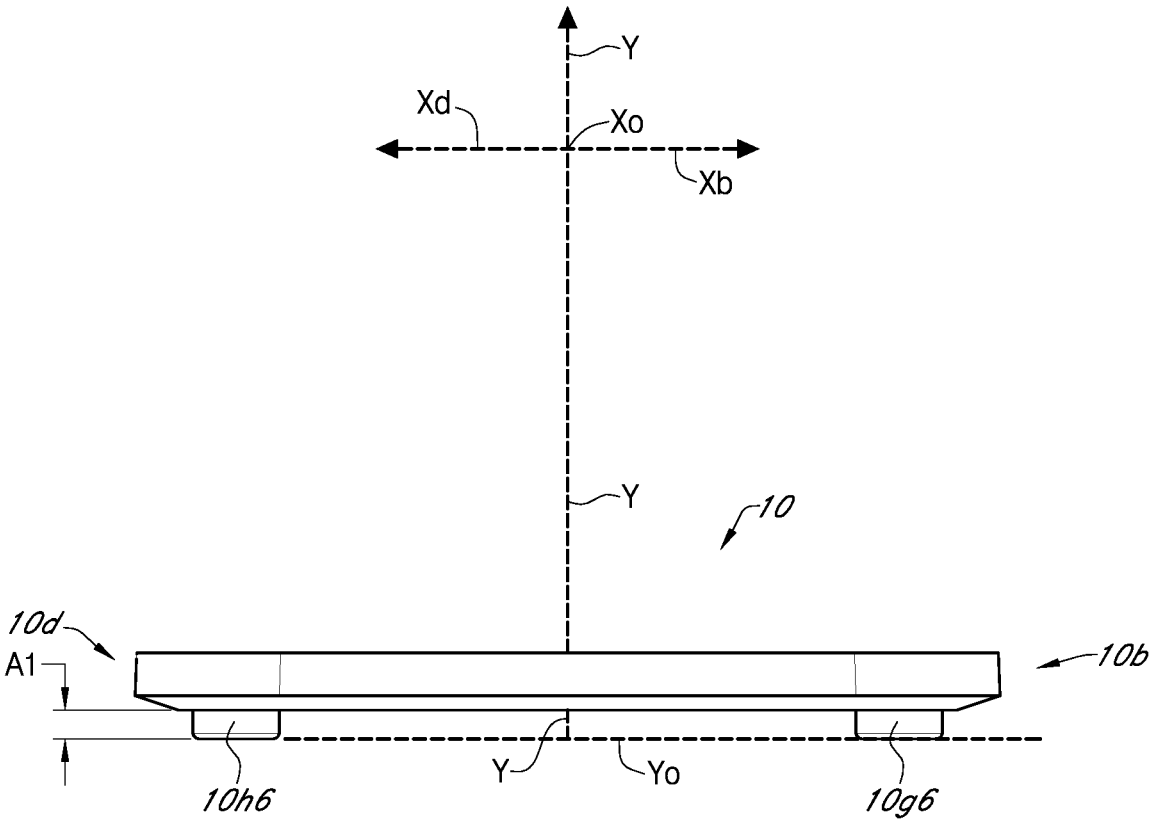
FIG. 3 is a side-elevational view showing aspects of the first implementation of the enhanced heating system including aspects of baseplate assembly.

Turning to FIG. 3, depicted therein is a side-elevational view showing aspects of the first implementation of the enhanced heater system 28 (e.g. see, FIG. 12) including aspects of baseplate assembly 10 and depicted with use of height dimension A1, which is some implementations can be at least an inch in dimension to allow for sufficient airflow into enhanced heating system.

Figure 4:
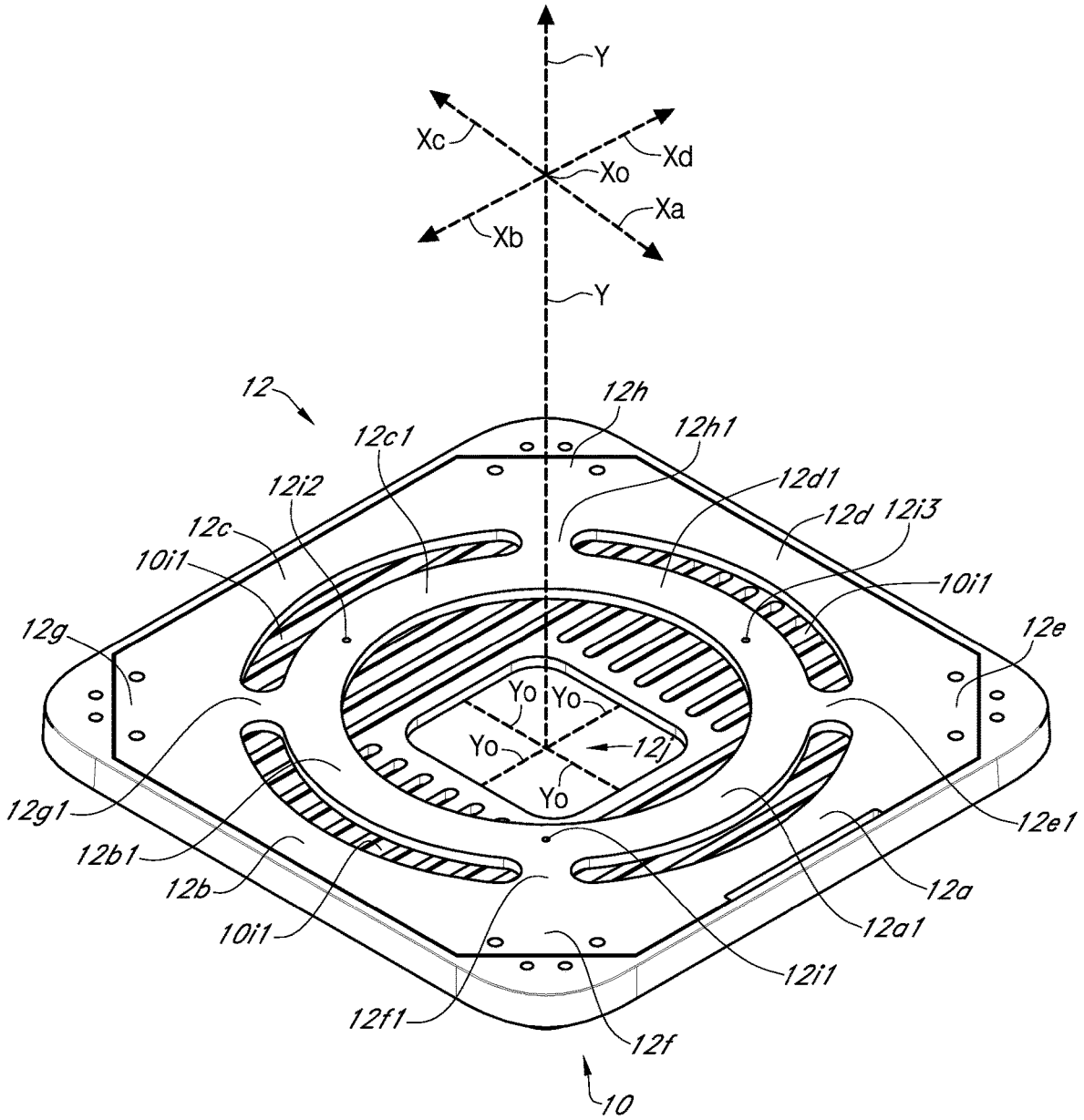
FIG. 4 is a perspective view showing aspects of the first implementation of the enhanced heating system including aspects of baseplate assembly and support plate assembly.

Turning to FIG. 4, depicted therein is a perspective view showing aspects of the first implementation of the enhanced heater system 28 (e.g. see, FIG. 12) including aspects of baseplate assembly 10 and support plate assembly 12.

In implementations, support plate assembly 12 is shown to include side portion 12*a*, side portion 12*b*, side portion 12*c*, side portion 12*d*, corner portion 12*e*, corner portion 12*f*, corner portion 12*g*, corner portion 12*h*, coupling point 12*i*1, coupling point 12*i*2, coupling point 12*i*3, and central aperture 12*j*. In implementations, side portion 12*a* is shown to include arch portion 12*a*1. In implementations, side portion 12*b* is shown to include arch portion 12*b*1. In implementations, side portion 12*c* is shown to include arch portion 12*c*1. In implementations, side portion 12*d* is shown to include arch portion 12*d*1. In implementations, corner portion 12*e* is shown to include span portion 12*e*1. In implementations, corner portion 12*f* is shown to include span portion 12*f*1. In implementations, corner portion 12*g* is shown to include span portion 12*g*1. In implementations, corner portion 12*h* is shown to include span portion 12*h*1.

Figure 5:
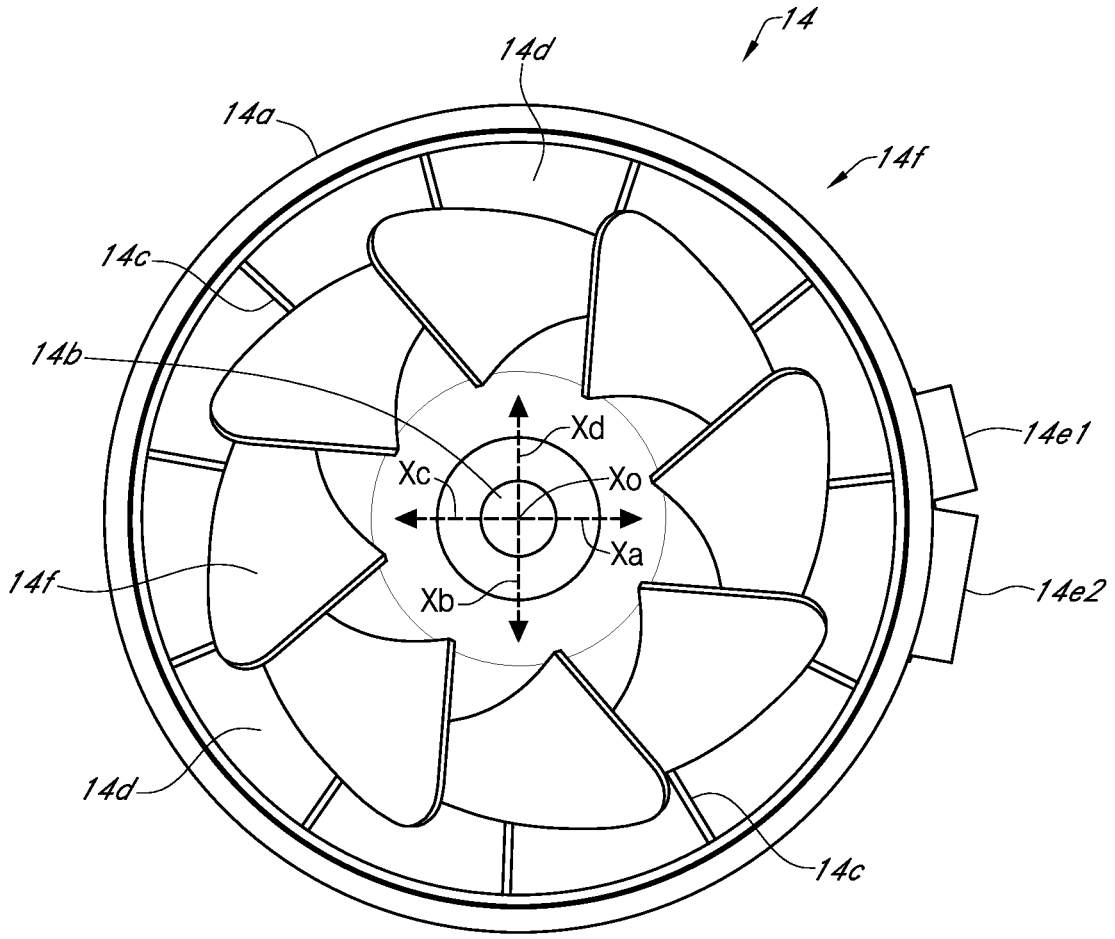
FIG. 5 is a bottom plan view showing aspects of the first implementation of the enhanced heating system including aspects of fan assembly.

Turning to FIG. 5, depicted therein is a bottom plan view showing aspects of the first implementation of the enhanced heater system 28 (e.g. see, FIG. 12) including aspects of fan assembly 14.

In implementations, fan assembly 14 is shown to include upper cylindrical member 14*a*, motor 14*b*, support member 14*c*, and vertical passage 14*d*. In implementations, fan assembly 14 is shown to include controller 14*e*1 and controller 14*e*2.

Figure 6:
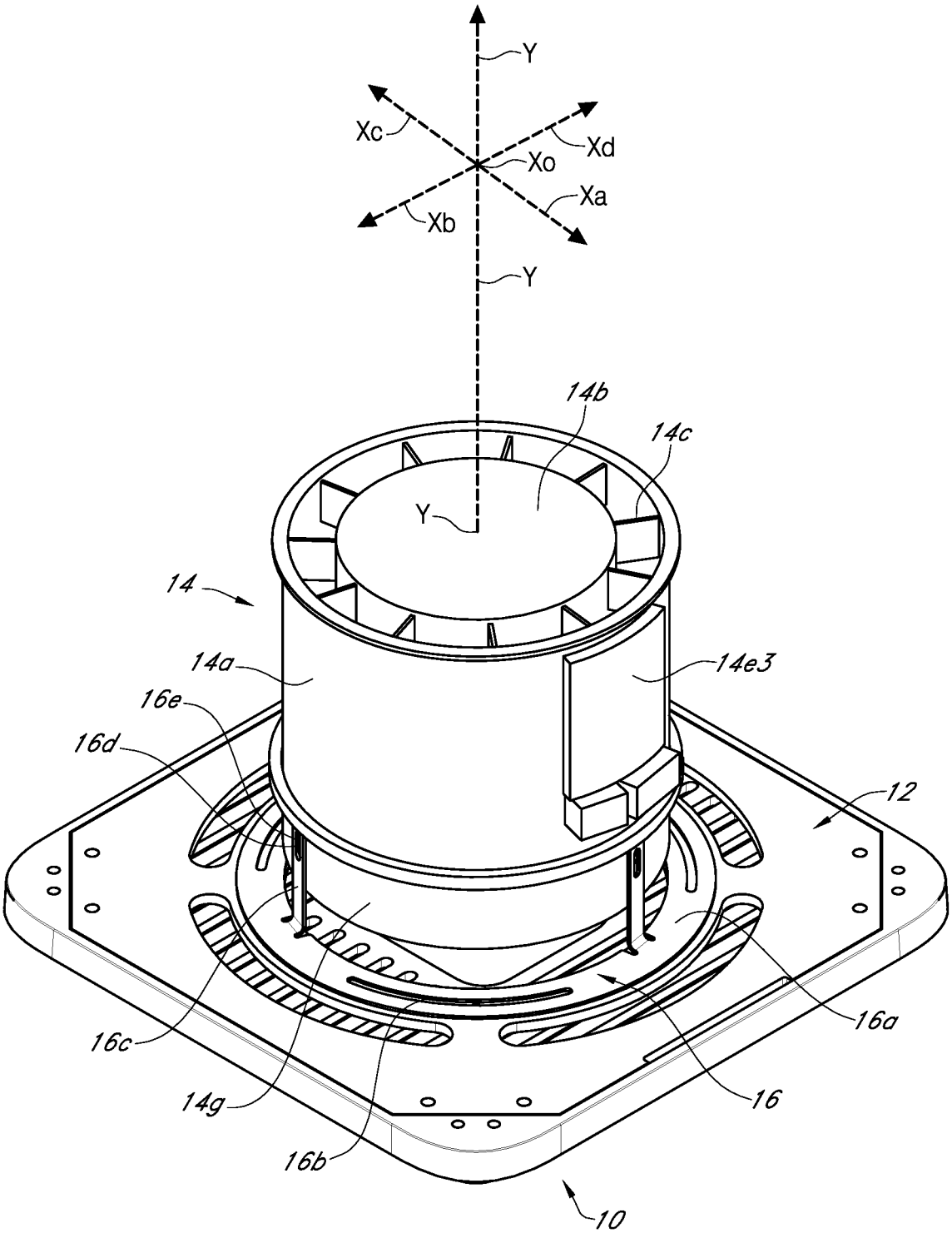
FIG. 6 is a perspective view showing aspects of the first implementation of the enhanced heating system including aspects of baseplate assembly, support plate assembly, and fan assembly.

Turning to FIG. 6, depicted therein is a perspective view showing aspects of the first implementation of the enhanced heater system 28 (e.g. see, FIG. 12) including aspects of baseplate assembly 10, support plate assembly 12, and fan assembly 14.

In implementations, fan assembly 14 is shown in FIG. 6 to include heat shield 14*e*3. In implementations, fan blade 14*f*. In implementations, fan assembly 14 is shown in FIG. 6 to include lower cylindrical member 14*g*. In implementations, brace assembly 16 is shown to include ring member 16*a*, arched aperture 16*b*, vertical member 16*c*, coupling point 16*d*, and slot portion 16*e*.

Figure 7:
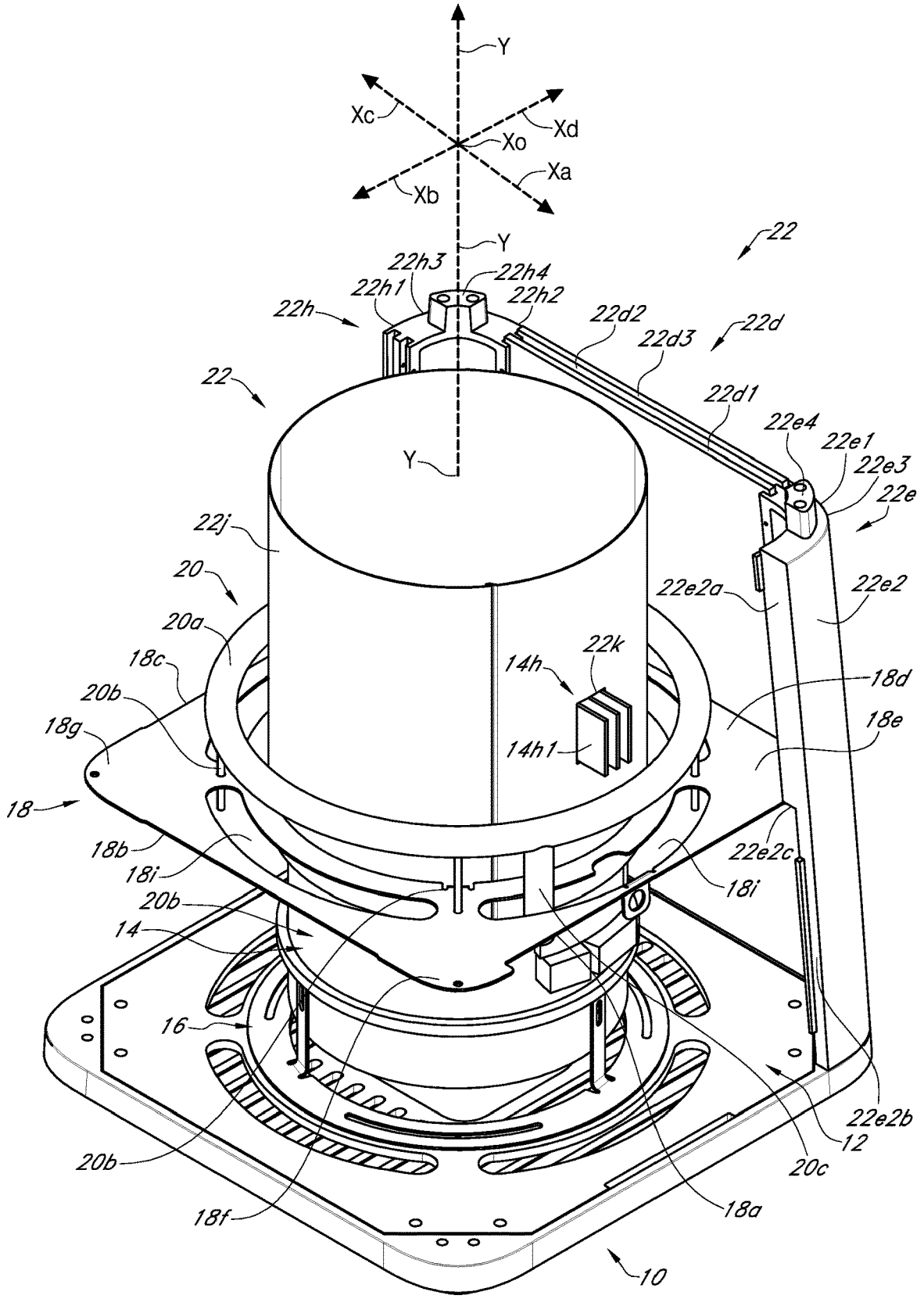
FIG. 7 is a perspective view showing aspects of the first implementation of the enhanced heating system including aspects of baseplate assembly, support plate assembly, fan assembly, brace assembly, support plate assembly, burner assembly, and enclosure assembly.

Turning to FIG. 7, depicted therein is a perspective view showing aspects of the first implementation of the enhanced heater system 28 (e.g. see, FIG. 12) including aspects of baseplate assembly 10, support plate assembly 12, fan assembly 14, brace assembly 16, support plate assembly 18, burner assembly 20, and enclosure assembly 22.

In implementations, fan assembly 14 is shown in FIG. 7 to include Seebeck thermoelectric generator assembly 14*h*.

In implementations, Seebeck thermoelectric generator assembly 14*h* is shown to include hot-side heat exchanger 14*h*1. In implementations, support plate assembly 18 is shown to include recessed side 18*a*, recessed side 18*b*, recessed side 18*c*, recessed side 18*d*, corner portion 18*e*, corner portion 18*f*, corner portion 18*g*, and arched aperture 18*i*. In implementations, burner assembly 20 is shown to include ring burner 20*a*, support strut 20*b*, and pipe member 20*c*. In implementations, enclosure assembly 22 is shown to include side assembly fixed 22*d*, canted post member 22*e*, canted post member 22*h*, cylindrical duct member 22*j*, duct aperture 22*k*. In implementations, side assembly fixed 22*d* is shown to include interior window pane 22*d*1, intermediate gap area 22*d*2, and exterior window pane 22*d*3. In implementations, canted post member 22*e* is shown to include side portion 22*e*1, side portion 22*e*2, corner portion 22*e*3, and coupling member 22*e*4. In implementations, side portion 22*e*2 is shown to include vertical upper engagement surface 22*e*2*a*, vertical lower engagement surface 22*e*2*b*, and horizontal engagement surface 22*e*2*c*. In implementations, canted post member 22*h* is shown to include side portion 22*h*1, side portion 22*h*2, corner portion 22*h*3, and coupling member 22*h*4.

Figure 8:
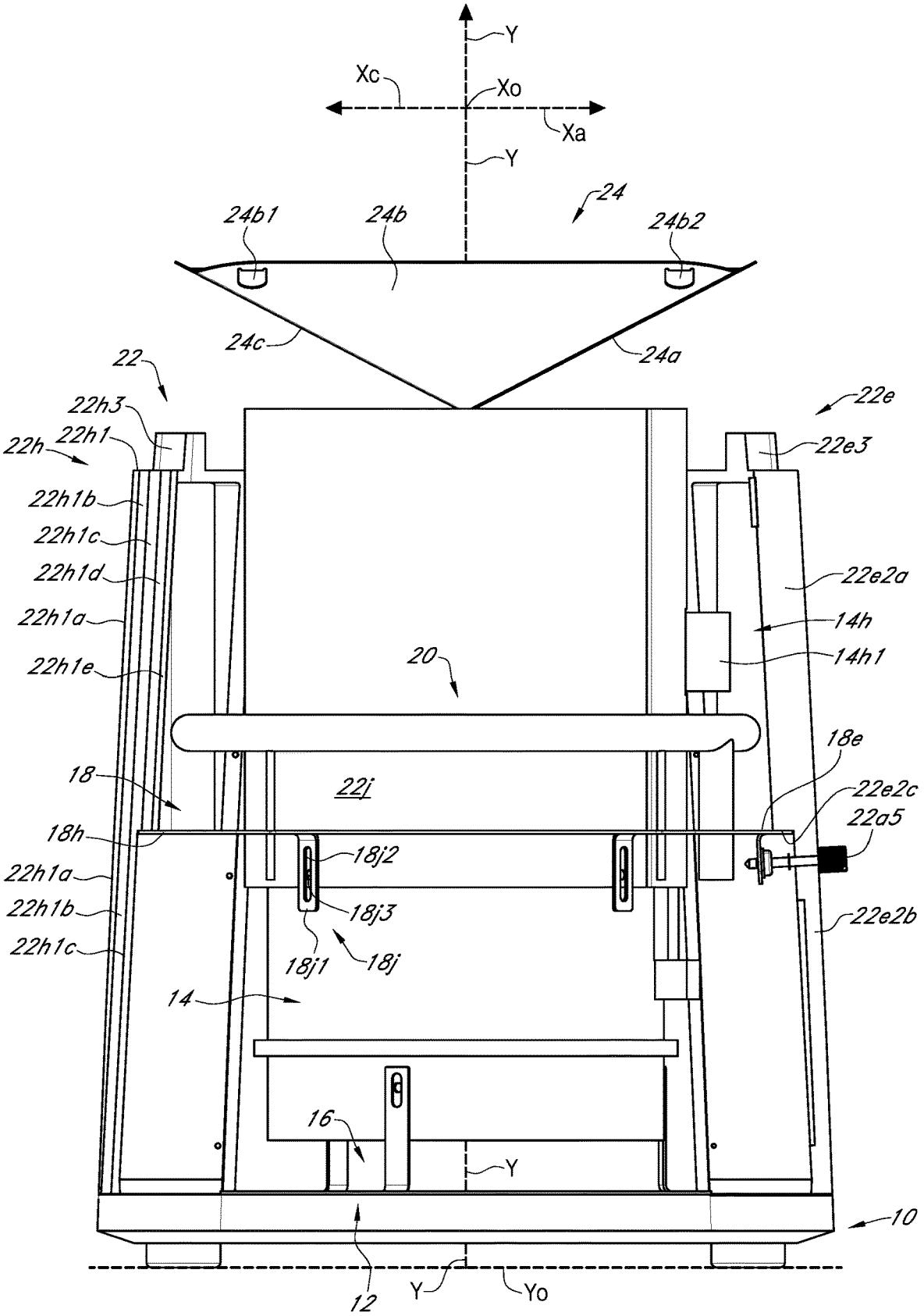
FIG. 8 is a side elevational view showing aspects of the first implementation of the enhanced heating system including aspects of baseplate assembly, support plate assembly, fan assembly, brace assembly, support plate assembly, burner assembly, enclosure assembly, and pyramidal deflector assembly.

Turning to FIG. 8, depicted therein is a side elevational view showing aspects of the first implementation of the enhanced heater system 28 (e.g. see, FIG. 12) including aspects of baseplate assembly 10, support plate assembly 12, fan assembly 14, brace assembly 16, support plate assembly 18, burner assembly 20, enclosure assembly 22, and pyramidal deflector assembly 24.

In implementations, support plate assembly 18 is shown in FIG. 8 to include corner portion 18*h* and bracket portion 18*j*. In implementations, bracket portion 18*j* is shown to include vertical member 18*j*1, slot portion 18*j*2, and coupling point 18*j*3. In implementations, enclosure assembly 22 is shown in FIG. 8 to include door knob assembly 22*a*5, which is included in side assembly movable 22*a* (see FIG. 10). In implementations, enclosure assembly 22 is shown in FIG. 8 to include exterior channel wall 22*h*1*a*, exterior channel 22*h*1*b*, intermediate channel wall 22*h*1*c*, interior channel 22*h*1*d*, and interior channel wall 22*h*1*e*, which are included in side portion 22*h*1 (see FIG. 7). In implementations, pyramidal deflector assembly 24, is shown to include triangular side portion 24*a*, triangular side portion 24*b*, and triangular side portion 24*c*. In implementations, triangular side portion 24*a* is shown to include coupler 24*a*1 and coupler 24*a*2. In implementations, triangular side portion 24*b* is shown to include coupler 24*b*1 and coupler 24*b*2.

Figure 9:
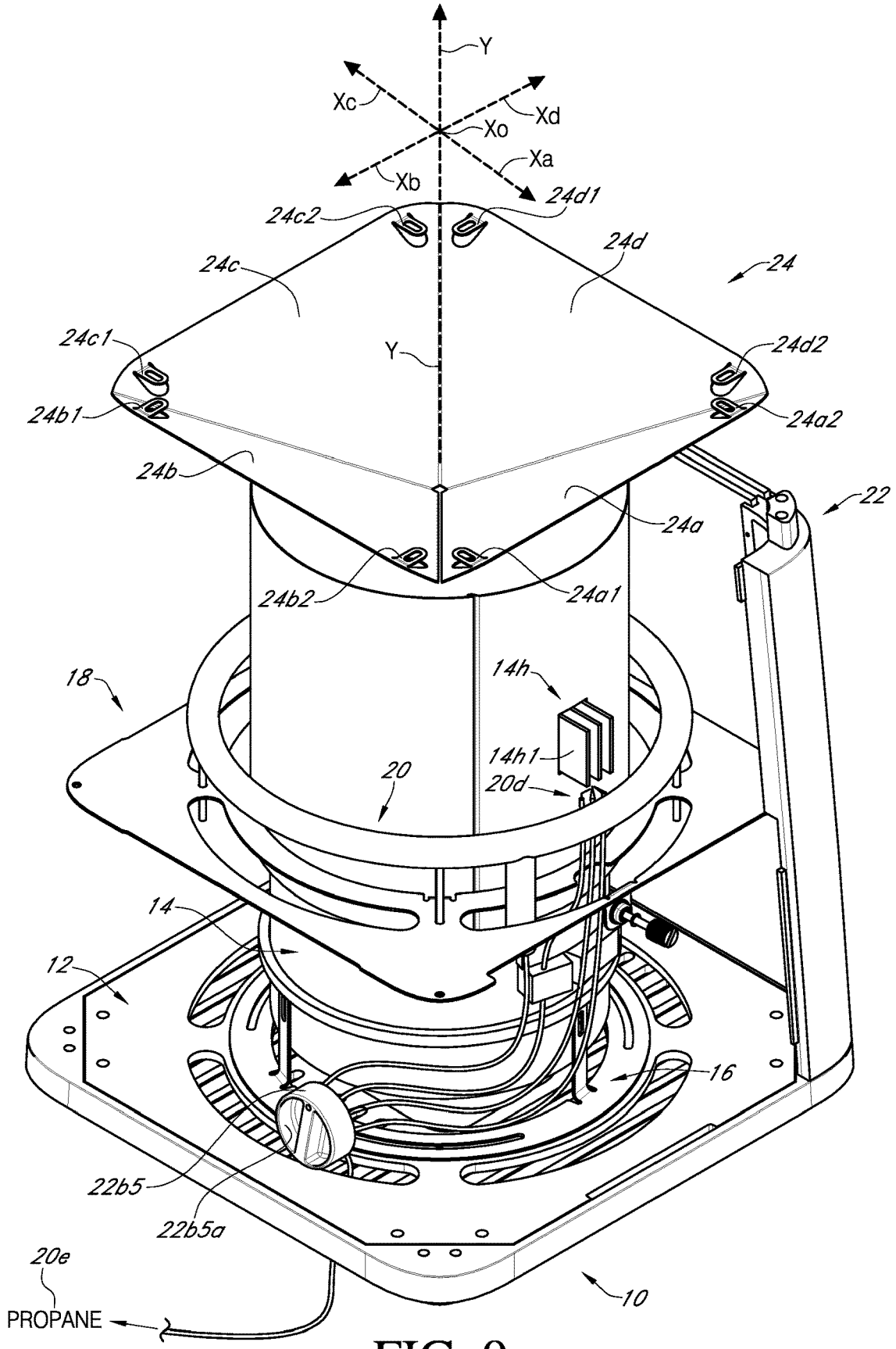
FIG. 9 is a perspective view showing aspects of the first implementation of the enhanced heating system including aspects of baseplate assembly, support plate assembly, fan assembly, brace assembly, support plate assembly, burner assembly, enclosure assembly, and pyramidal deflector assembly.

Turning to FIG. 9, depicted therein is a perspective view showing aspects of the first implementation of the enhanced heater system 28 (e.g. see, FIG. 12) including aspects of baseplate assembly 10, support plate assembly 12, fan assembly 14, brace assembly 16, support plate assembly 18, burner assembly 20, enclosure assembly 22, and pyramidal deflector assembly 24.

In implementations, burner assembly 20 is shown in FIG. 9 to include igniter-sensor system 20*d* and external gaseous fuel storage 20*e*. In implementations, enclosure assembly 22 is shown in FIG. 9 to include input control system 22*b*5 which is included in side assembly fixed 22*b* (see FIG. 10). In implementations, input control system 22*b*5 is shown to include control knob 22*b*5*a*. In implementations, pyramidal deflector assembly 24 is shown in FIG. 9 to include coupler 24*a*1 and coupler 24*a*2 which are included in triangular side portion 24*a* (see FIG. 8). In implementations, pyramidal deflector assembly 24 is shown in FIG. 9 to include coupler 24*c*1 and coupler 24*c*2 which are included by triangular side portion 24*c* (see FIG. 8). In implementations, pyramidal deflector assembly 24 is shown in FIG. 9 to include triangular side portion 24*d*. In implementations, triangular side portion 24*d* is shown to include coupler 24*d*1 and coupler 24*d*2.

Figure 10:
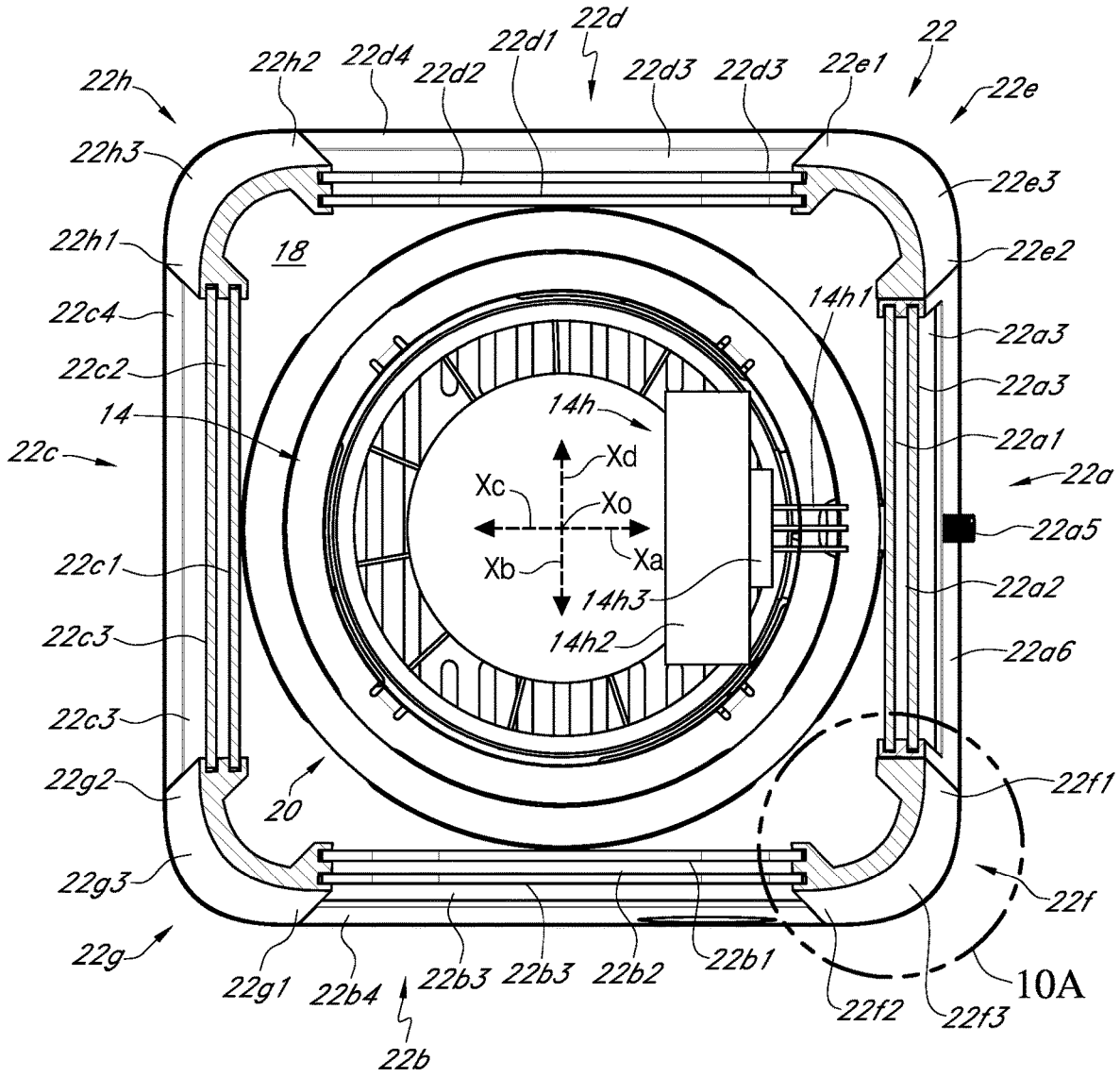
FIG. 10 is a cross-sectional top plan view showing aspects of the first implementation of the enhanced heating system including aspects of fan assembly, support plate assembly, burner assembly, and enclosure assembly.

Turning to FIG. 10, depicted therein is a cross-sectional top plan view showing aspects of the first implementation of the enhanced heater system 28 (e.g. see, FIG. 12) including aspects of fan assembly 14, support plate assembly 18, burner assembly 20, and enclosure assembly 22.

In implementations, fan assembly 14 is shown in FIG. 10 to include cool-side heat exchanger 14*h*2 and Seebeck thermoelectric generator electronics 14*h*3 which are included in Seebeck thermoelectric generator assembly 14*h* (see FIG. 7). In implementations, enclosure assembly 22 is shown in FIG. 10 to include side assembly movable 22*a*. In implementations, side assembly movable 22*a* is shown to include interior window pane 22*a*1, intermediate gap area 22*a*2, exterior window pane 22*a*3, and enclosure assembly 22. In implementations, enclosure assembly 22 is shown in FIG. 10 to include side assembly fixed 22*b*. In implementations, side assembly fixed 22*b* is shown to include interior window pane 22*b*1, intermediate gap area 22*b*2, exterior window pane 22*b*3, and exterior lower panel 22*b*4. In implementations, enclosure assembly 22 is shown in FIG. 10 to include side assembly fixed 22*c*, canted post member 22*f*, and canted post member 22*g*. In implementations, side assembly fixed 22*c* is shown to include interior window pane 22*c*1, intermediate gap area 22*c*2, exterior window pane 22*c*3, and exterior lower panel 22*c*4. In implementations, enclosure assembly 22 is shown in FIG. 10 to include exterior lower panel 22*d*4 which is included in side assembly fixed 22*d* (see FIG. 7). In implementations, canted post member 22*f* is shown to include side portion 22*f*1, side portion 22*f*2, and corner portion 22*f*3. In implementations, canted post member 22*g* is shown to include side portion 22*g*1, side portion 22*g*2, and corner portion 22*g*3.

Figure 10A:
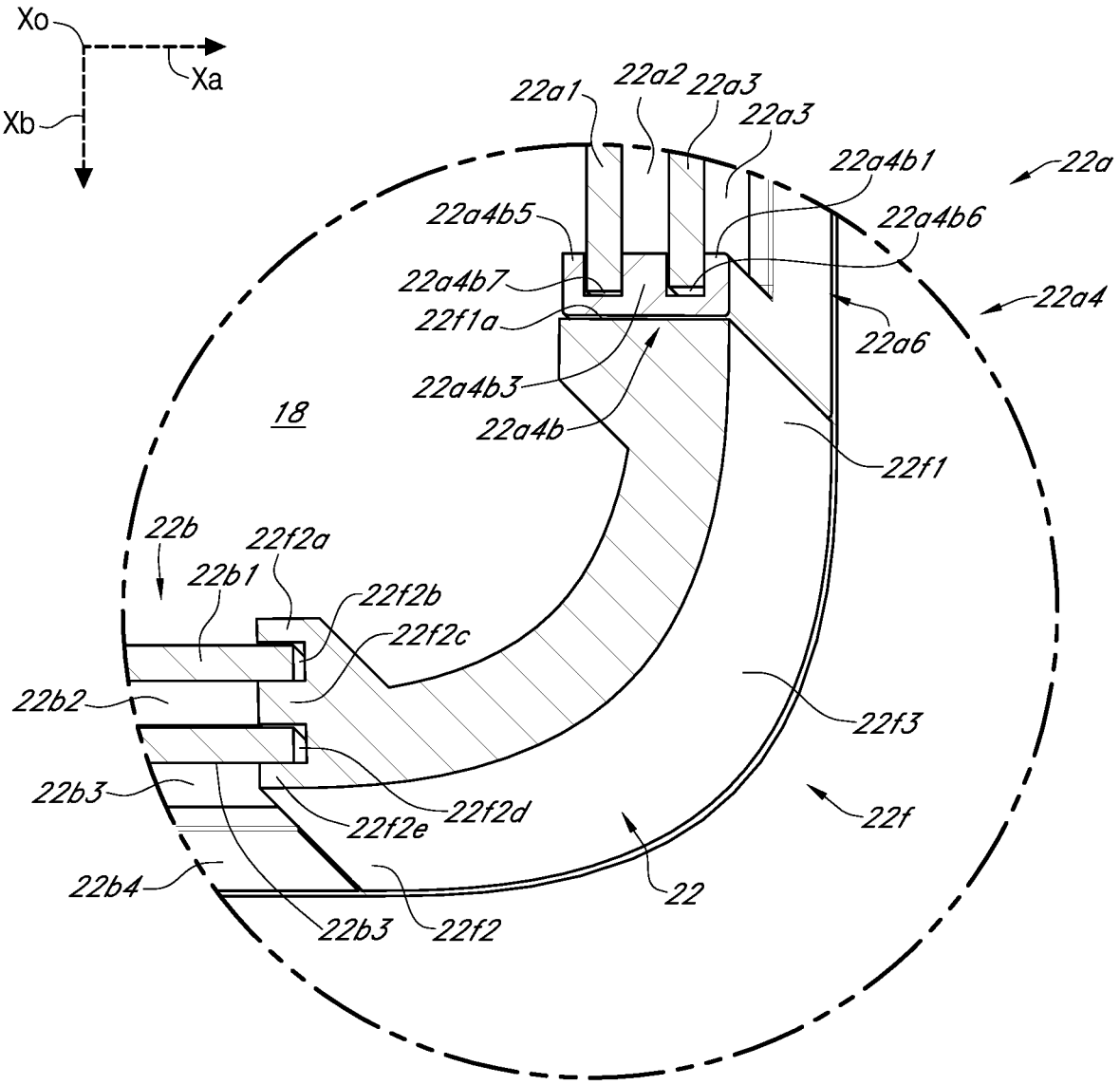
FIG. 10A is an enlarged portion of the cross-sectional top plan view of FIG. 10 showing aspects of the first implementation of the enhanced heating system including aspects of support plate assembly and enclosure assembly.

Turning to FIG. 10A, depicted therein is an enlarged portion of the cross-sectional top plan view of FIG. 10 showing aspects of the first implementation of the enhanced heater system 28 (e.g. see, FIG. 12) including aspects of support plate assembly 18 and enclosure assembly 22.

Figure 15:
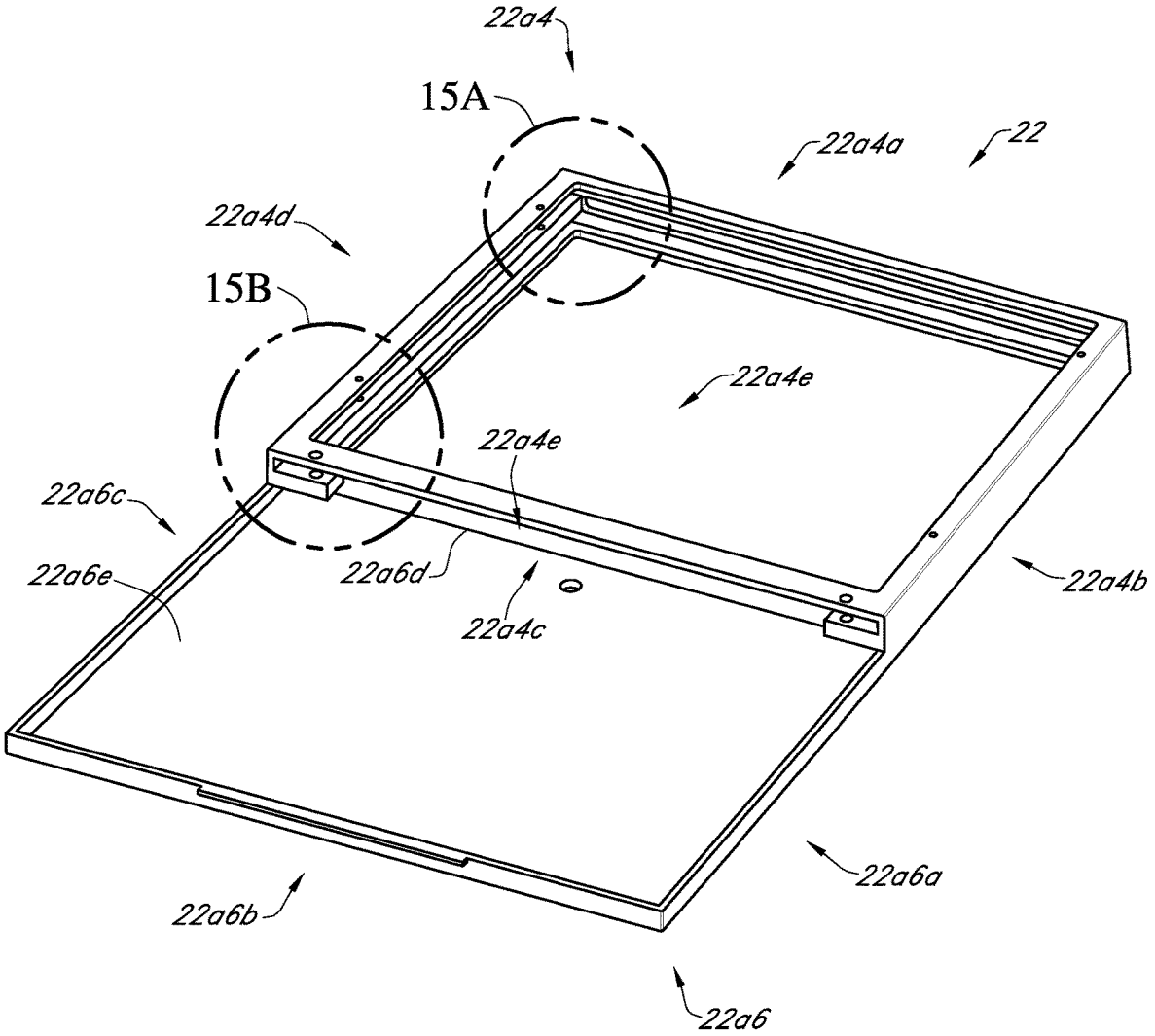
FIG. 15 is a perspective view showing aspects of the first implementation of the enhanced heating system including aspects of enclosure assembly.

In implementations, enclosure assembly 22 is shown in FIG. 10A to include vertical side portion 22*a*4*b* which is included in window pane assembly 22*a*4 (see FIG. 15). In implementations, vertical side portion 22*a*4*b* is shown to include exterior channel wall 22*a*4*b*1, intermediate channel wall 22*a*4*b*3, interior channel wall 22*a*4*b*5, exterior channel 22*a*4*b*6, and interior channel 22*a*4*b*7. In implementations, enclosure assembly 22 is shown in FIG. 10A to include support pin aperture 22*a*4*c*5 which is included by side aperture portion 22*a*4*c* (see FIG. 13). In implementations, enclosure assembly 22 is shown in FIG. 10A to include vertical engagement surface 22*f*1*a* which is included by side portion 22*f*1 (see FIG. 10). In implementations, enclosure assembly 22 is shown in FIG. 10A to include interior channel wall 22*f*2*a*, interior channel 22*f*2*b*, intermediate channel wall 22*f*2*c*, exterior channel 22*f*2*d*, and exterior channel wall 22*f*2*e*, which are included in side portion 22*f*2 (see FIG. 10).

Figure 11:
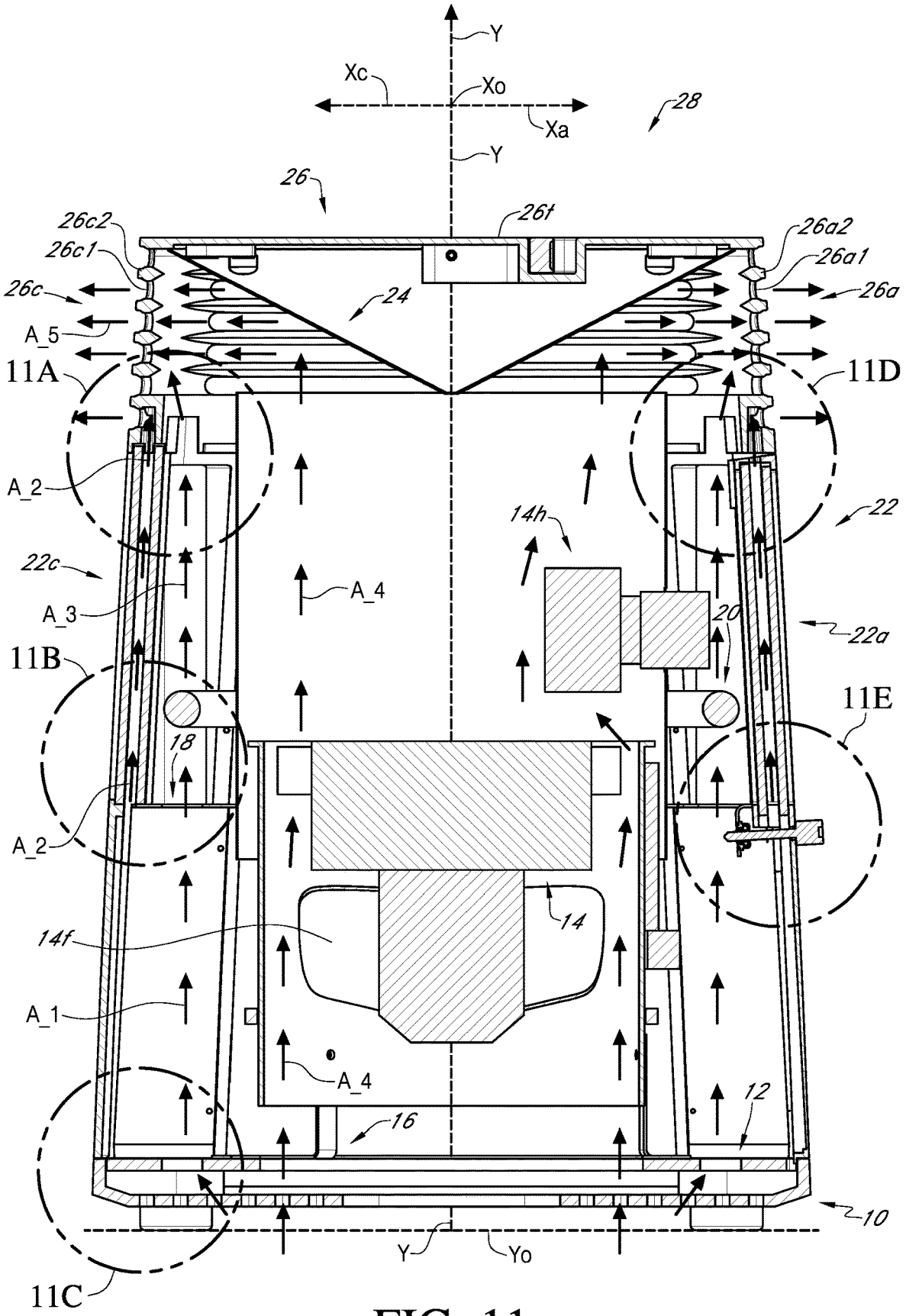
FIG. 11 is cross-sectional side elevational view showing aspects of the first implementation of the enhanced heating system including aspects of baseplate assembly 10, support plate assembly, fan assembly, brace assembly, support plate assembly, burner assembly, enclosure assembly, and pyramidal-deflector assembly.

Turning to FIG. 11, depicted therein is a cross-sectional side elevational view showing aspects of the first implementation of the enhanced heater system 28 (e.g. see, FIG. 12) including aspects of baseplate assembly 10, support plate assembly 12, fan assembly 14, brace assembly 16, support plate assembly 18, burner assembly 20, enclosure assembly 22, pyramidal deflector assembly 24 and pyramidal deflector assembly 24 and depicted with use of directional flow arrow A_1, directional flow arrow A_2, directional flow arrow A_3, directional flow arrow A_4, and directional flow arrow A_5.

In implementations, top enclosure assembly 26 is shown to include side assembly 26*a*, side assembly 26*c*, and top surface portion 26*t*. In implementations, side assembly 26*a* is shown to include aperture portion 26*a*1 and rib portion 26*a*2. In implementations, side assembly 26*c* is shown to include aperture portion 26*c*1 and rib portion 26*c*2. FIG. 11 depicts enhanced heater system 28.

Figure 11A:
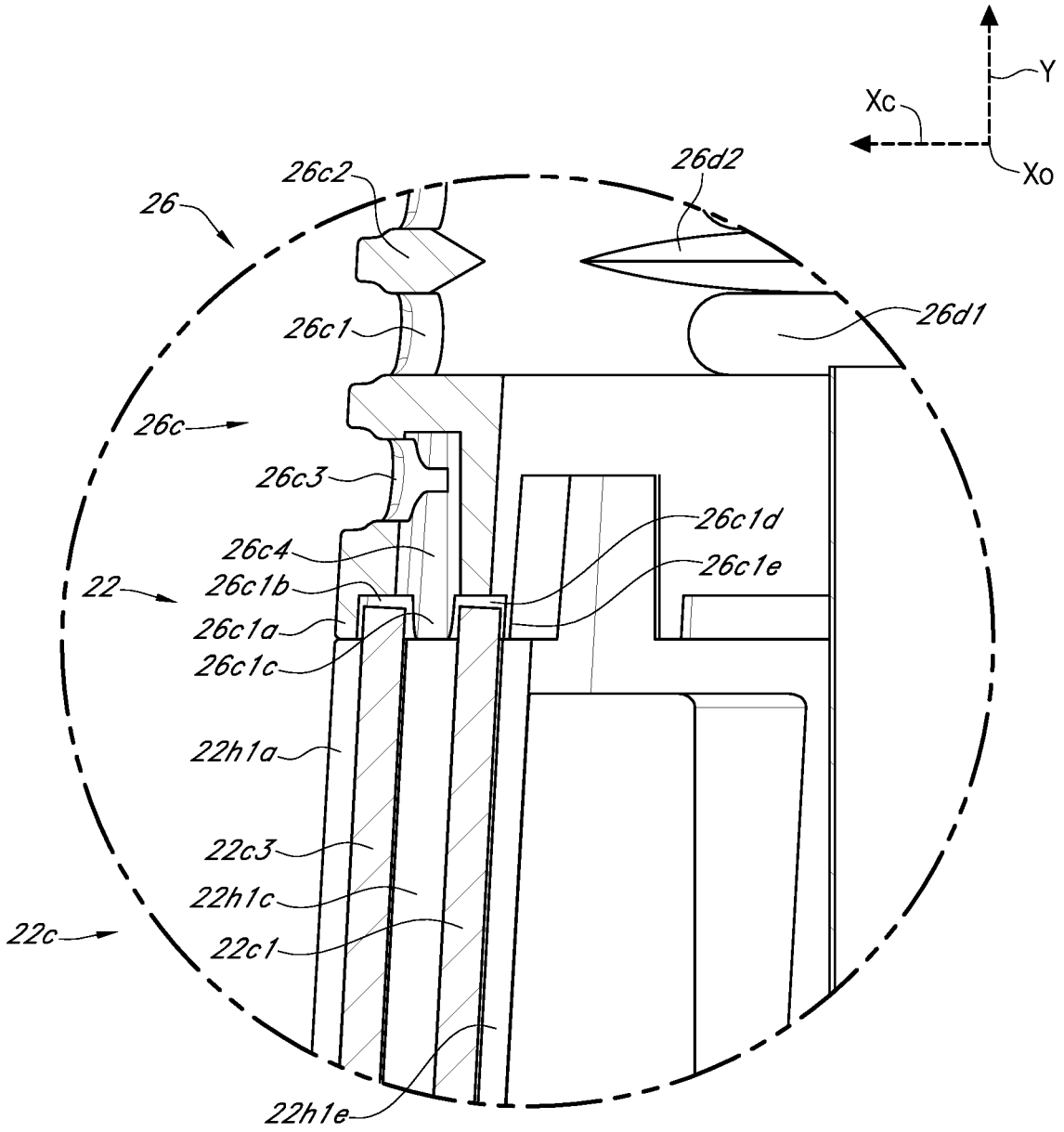
FIG. 11A is an enlarged portion of the cross-sectional side elevational view of FIG. 11 showing aspects of the first implementation of the enhanced heating system including aspects of enclosure assembly and top enclosure assembly.

Turning to FIG. 11A, depicted therein is an enlarged portion of the cross-sectional side elevational view of FIG. 11 showing aspects of the first implementation of the enhanced heater system 28 (e.g. see, FIG. 12) including aspects of enclosure assembly 22 and top enclosure assembly 26.

In implementations, top enclosure assembly 26 is shown in FIG. 11A to include exterior wall portion 26*c*1*a*, exterior channel 26*c*1*b*, intermediate channel wall 26*c*1*c*, interior channel 26*c*1*d*, and interior channel wall 26*c*1*e*, which are included by aperture portion 26*c*1 (see FIG. 11). In implementations, top enclosure assembly 26 is shown in FIG. 11A to include aperture portion 26*c*3 and aperture passage portion 26*c*4, which are included in side assembly 26*c* (see FIG. 11). In implementations, top enclosure assembly 26 is shown in FIG. 11A to include aperture portion 26*d*1 and rib portion 26*d*2, which are included in side assembly 26*d* (see FIG. 12).

Figure 11B:
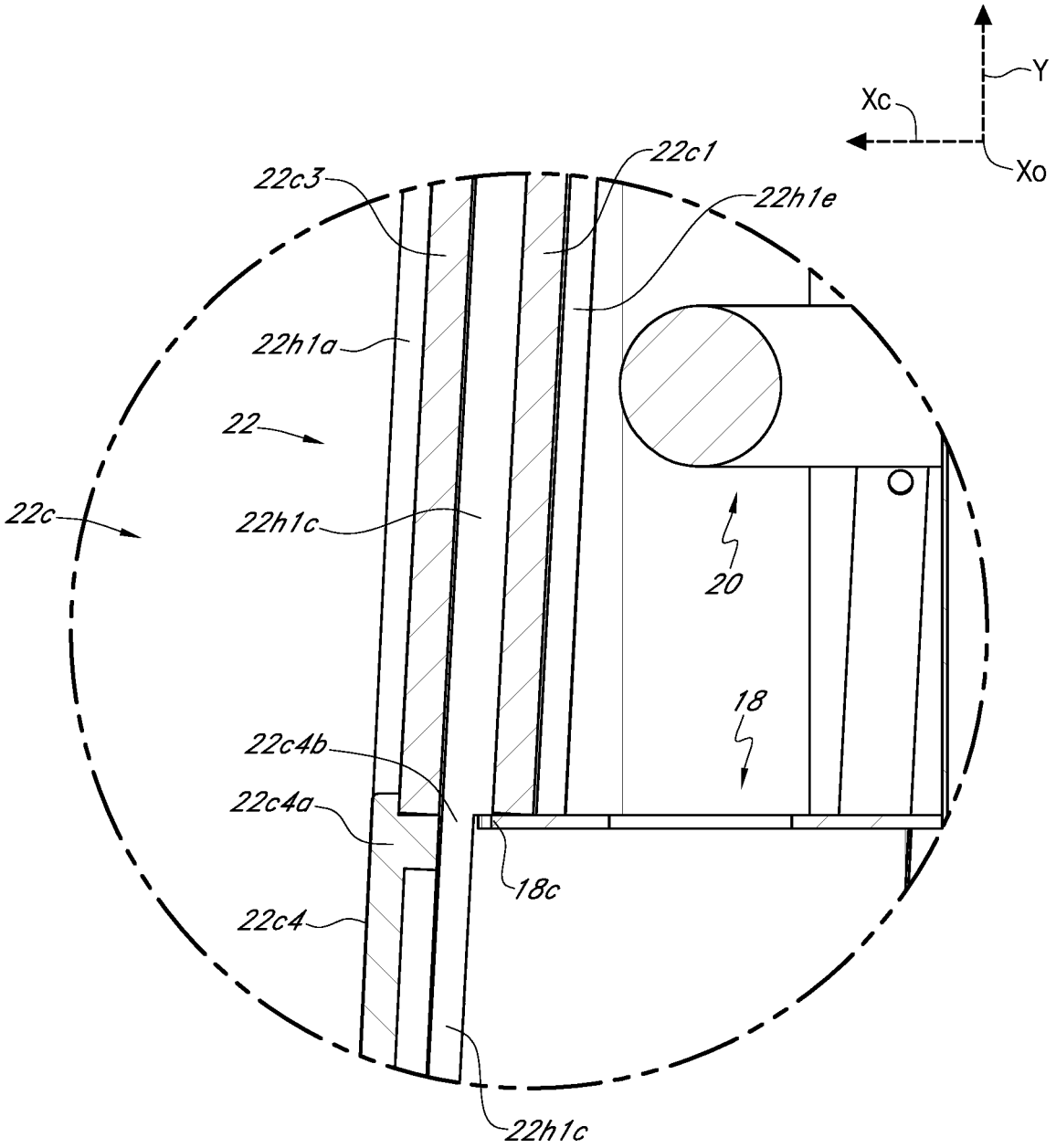
FIG. 11B is an enlarged portion of the cross-sectional side elevational view of FIG. 11 showing aspects of the first implementation of the enhanced heating system including aspects of support plate assembly, burner assembly and enclosure assembly.

Turning to FIG. 11B, depicted therein is an enlarged portion of the cross-sectional side elevational view of FIG. 11 showing aspects of the first implementation of the enhanced heater system 28 (e.g. see, FIG. 12) including aspects of support plate assembly 18, burner assembly 20 and enclosure assembly 22.

In implementations, enclosure assembly 22 is shown in FIG. 11B to include ledge support portion 22*c*4*a* and aperture passage portion 22*c*4*b* which is included in exterior lower panel 22*c*4 (see FIG. 10).

Figure 11C:
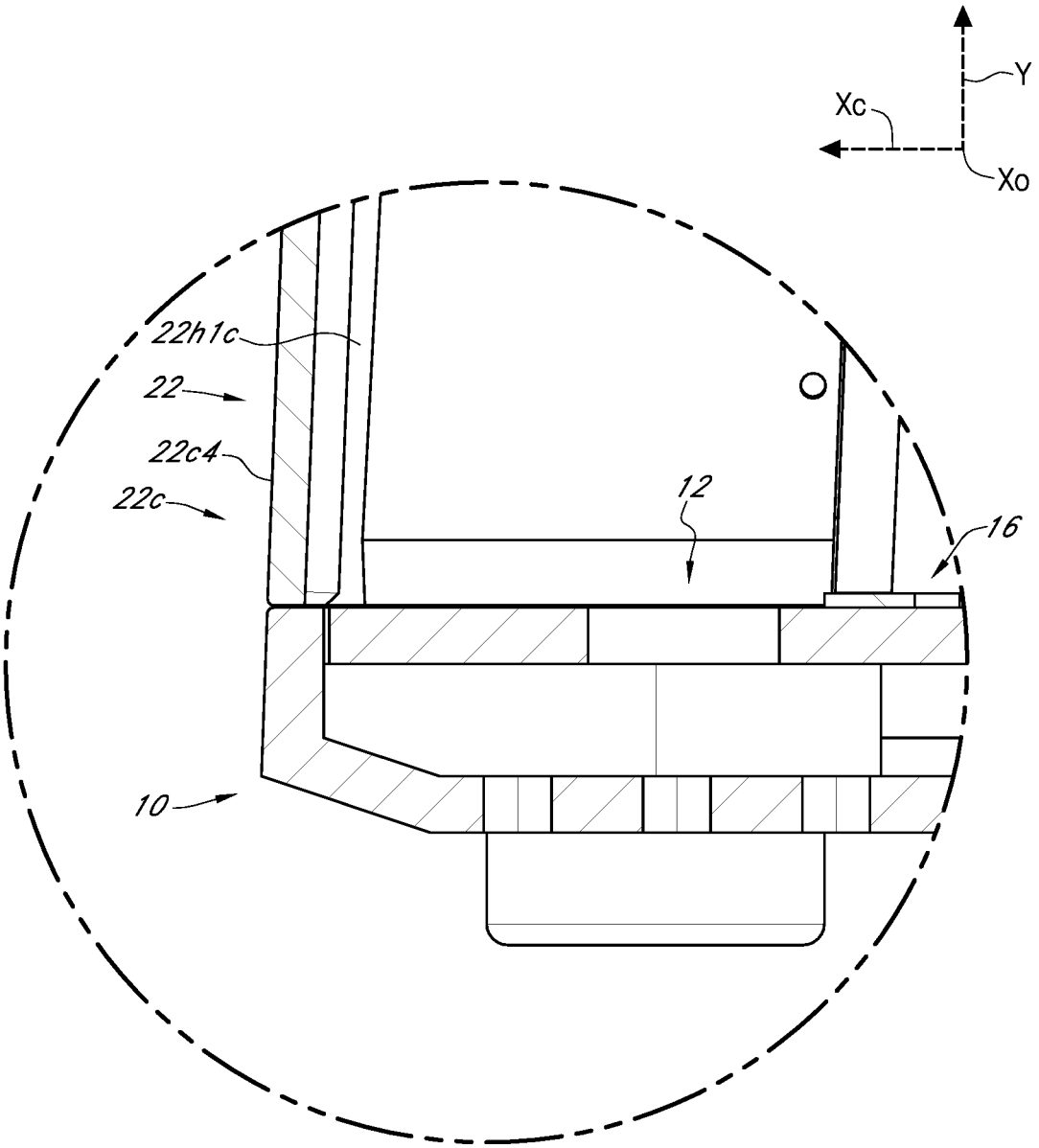
FIG. 11C is an enlarged portion of the cross-sectional side elevational view of FIG. 11 showing aspects of the first implementation of the enhanced heating system including aspects of baseplate assembly, support plate assembly, brace assembly, and enclosure assembly.

Turning to FIG. 11C, depicted therein is an enlarged portion of the cross-sectional side elevational view of FIG. 11 showing aspects of the first implementation of the enhanced heater system 28 (e.g. see, FIG. 12) including aspects of baseplate assembly 10, support plate assembly 12, brace assembly 16, and enclosure assembly 22.

Figure 11D:
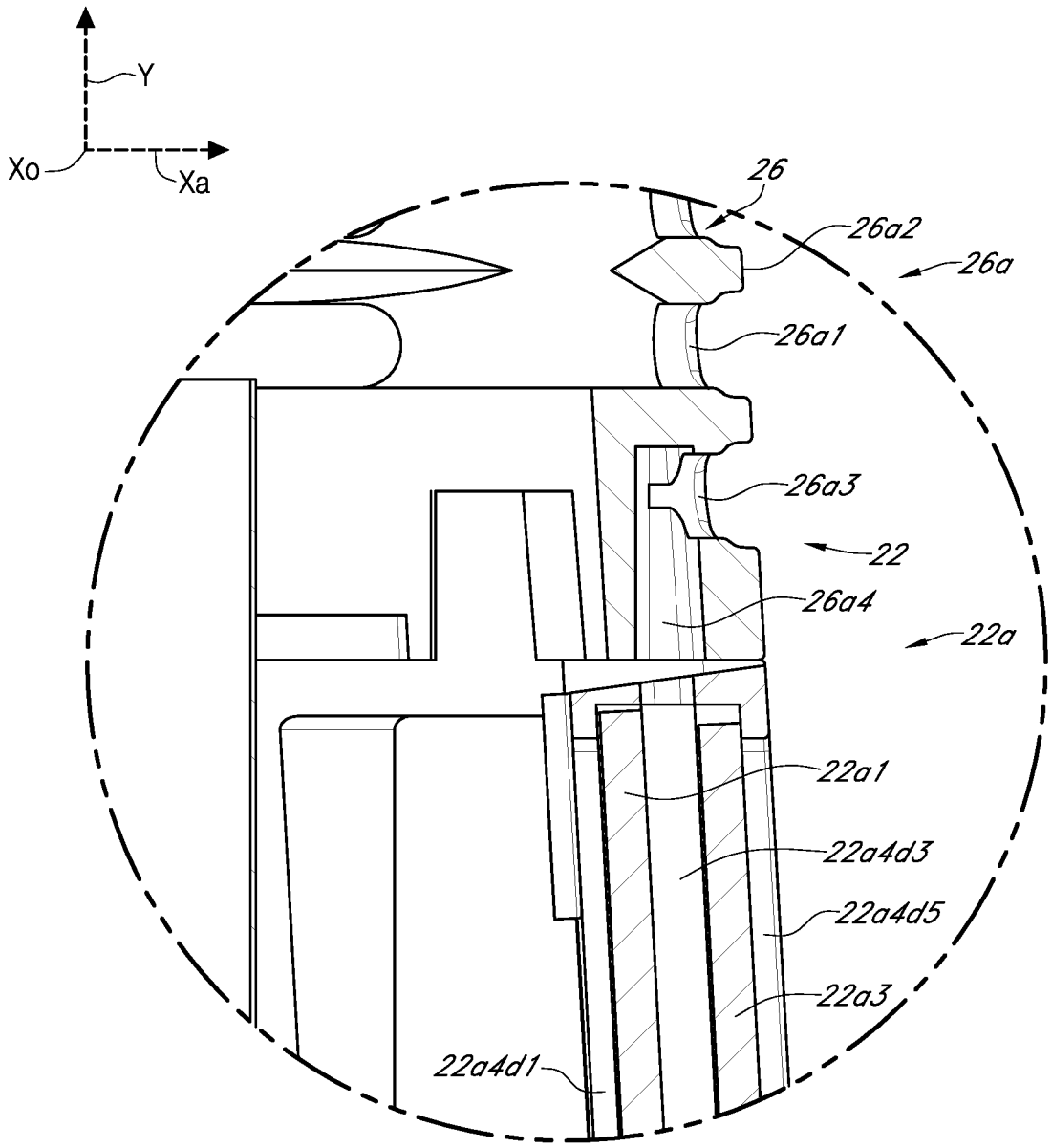
FIG. 11D is an enlarged portion of the cross-sectional side elevational view of FIG. 11 showing aspects of the first implementation of the enhanced heating system including aspects of enclosure assembly and top enclosure assembly.

Turning to FIG. 11D, depicted therein is an enlarged portion of the cross-sectional side elevational view of FIG. 11 showing aspects of the first implementation of the enhanced heater system 28 (e.g. see, FIG. 12) including aspects of enclosure assembly 22 and top enclosure assembly 26.

In implementations, enclosure assembly 22 is shown in FIG. 11D to include interior channel wall 22*a*4*d*1, intermediate channel wall 22*a*4*d*3, and exterior channel wall 22*a*4*d*5 which is included in side portion 22*a*4*d* (see FIG. 15). In implementations, top enclosure assembly 26 is shown in FIG. 11D to include aperture portion 26*a*3 and aperture passage portion 26*a*4 which are included in side assembly 26*a* (see FIG. 11).

Figure 11E:
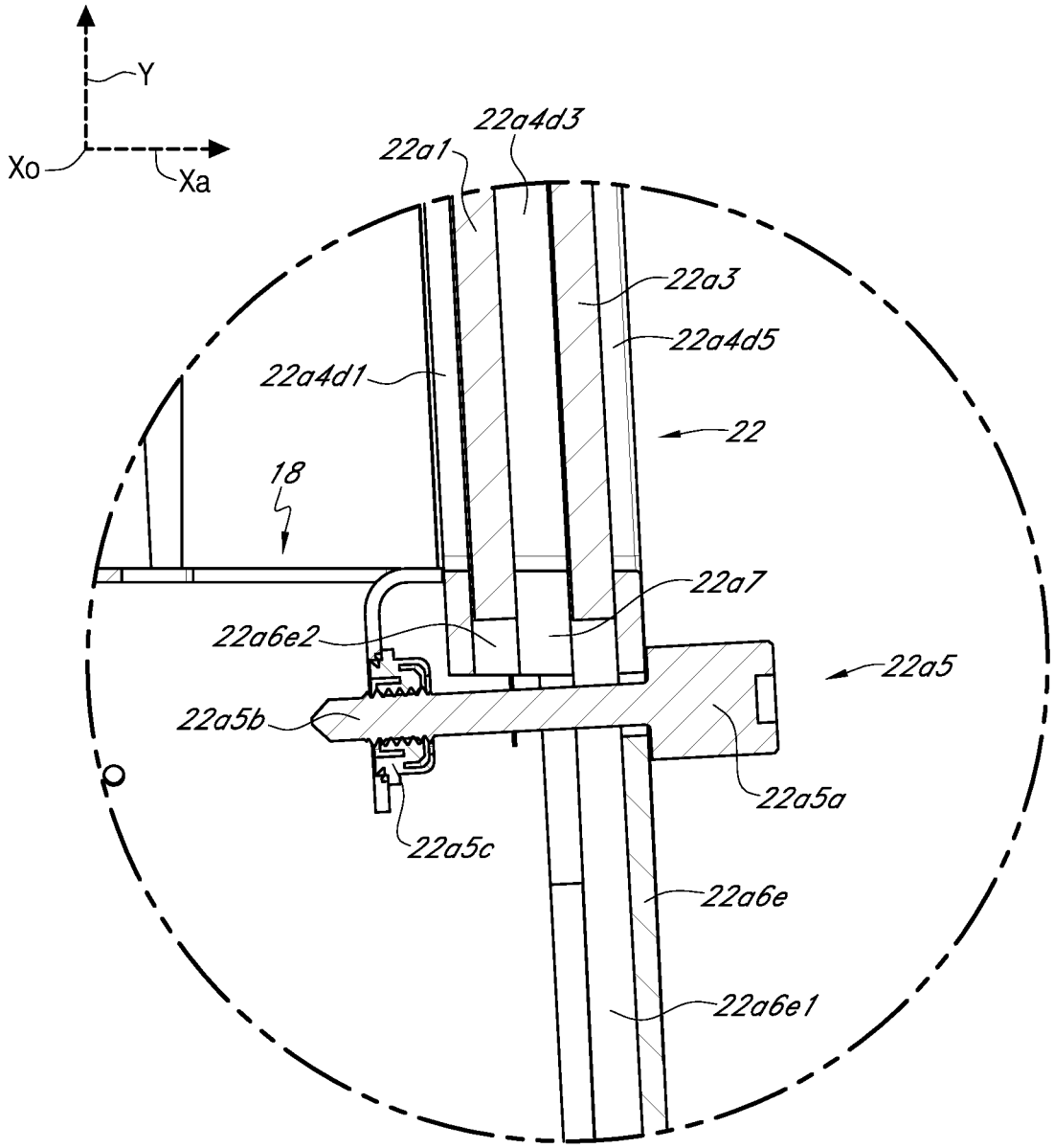
FIG. 11E is an enlarged portion of the cross-sectional side elevational view of FIG. 11 showing aspects of the first implementation of the enhanced heating system including aspects of baseplate assembly, support plate assembly, burner assembly, enclosure assembly, pyramidal deflector assembly, and top enclosure assembly.

Turning to FIG. 11E, depicted therein is an enlarged portion of the cross-sectional side elevational view of FIG. 11 showing aspects of the first implementation of the enhanced heater system 28 (e.g. see, FIG. 12) including aspects of baseplate assembly 10, support plate assembly 18, burner assembly 20, enclosure assembly 22, pyramidal deflector assembly 24, and top enclosure assembly 26.

In implementations, enclosure assembly 22 is shown in FIG. 11E to include knob portion 22*a*5*a*, stem portion 22*a*5*b*, and bracket portion 22*a*5*c*, which are included in door knob assembly 22*a*5 (see FIG. 8). In implementations, enclosure assembly 22 is shown in FIG. 11E to include lower panel portion 22*a*6*e*, which is included in exterior lower panel 22*a*6 (see FIG. 15). In implementations, lower panel portion 22*a*6*e* is shown to include ledge support portion 22*a*6*e*1 and ledge support portion 22*a*6*e*2. In implementations, enclosure assembly 22 is shown in FIG. 11E to include aperture passage portion 22*a*7, which is included in side assembly movable 22*a* (see FIG. 10).

Figure 12:
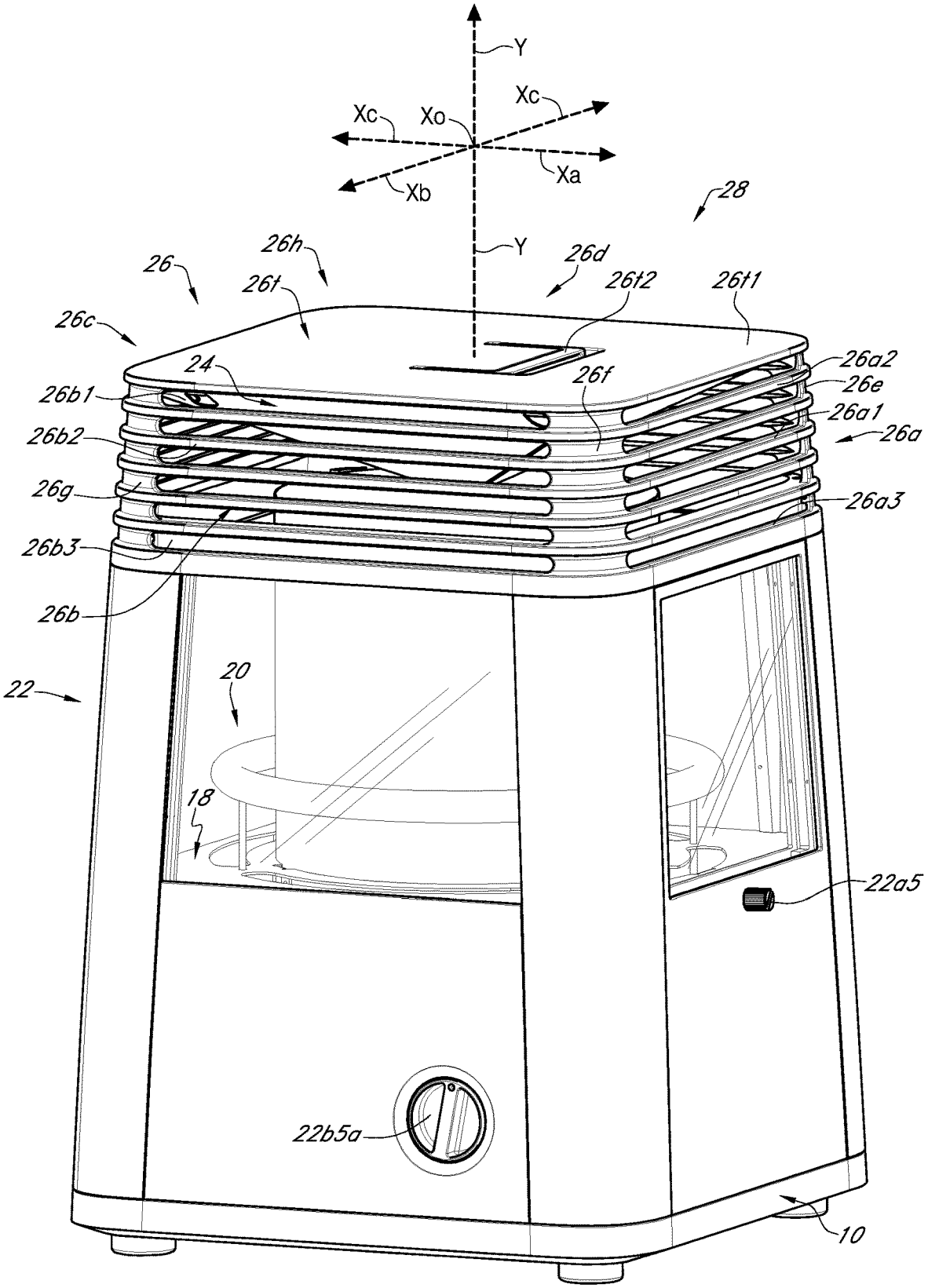
FIG. 12 is a perspective view showing aspects of the first implementation of the enhanced heating system as fully assembled including aspects of baseplate assembly, support plate assembly, burner assembly, enclosure assembly, pyramidal deflector assembly, and top enclosure assembly.

Turning to FIG. 12, depicted therein is a perspective view showing aspects of the first implementation of the enhanced heater system 28 as fully assembled including aspects of baseplate assembly 10, support plate assembly 18, burner assembly 20, enclosure assembly 22, pyramidal deflector assembly 24, and top enclosure assembly 26.

In implementations, top enclosure assembly 26 is shown in FIG. 12 to include side assembly 26*b*, side assembly 26*d*, corner portion 26*e*, corner portion 26*f*, corner portion 26*g*, and corner portion 26*h*. In implementations, side assembly 26*b* is shown to include aperture portion 26*b*1, rib portion 26*b*2, and aperture portion 26*b*3. In implementations, top enclosure assembly 26 is shown in FIG. 12 to include top surface portion 26*t*1 and handle portion 26*t*2, which is included in top surface portion 26*t* (see FIG. 11).

Figure 13:
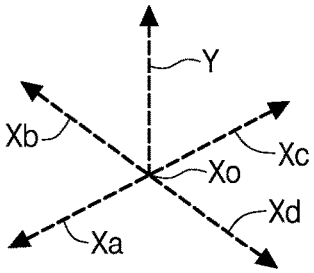
FIG. 13 is an enlarged perspective view showing aspects of the first implementation of the enhanced heating system including aspects of support plate assembly, burner assembly, and enclosure assembly.
Figure 13:
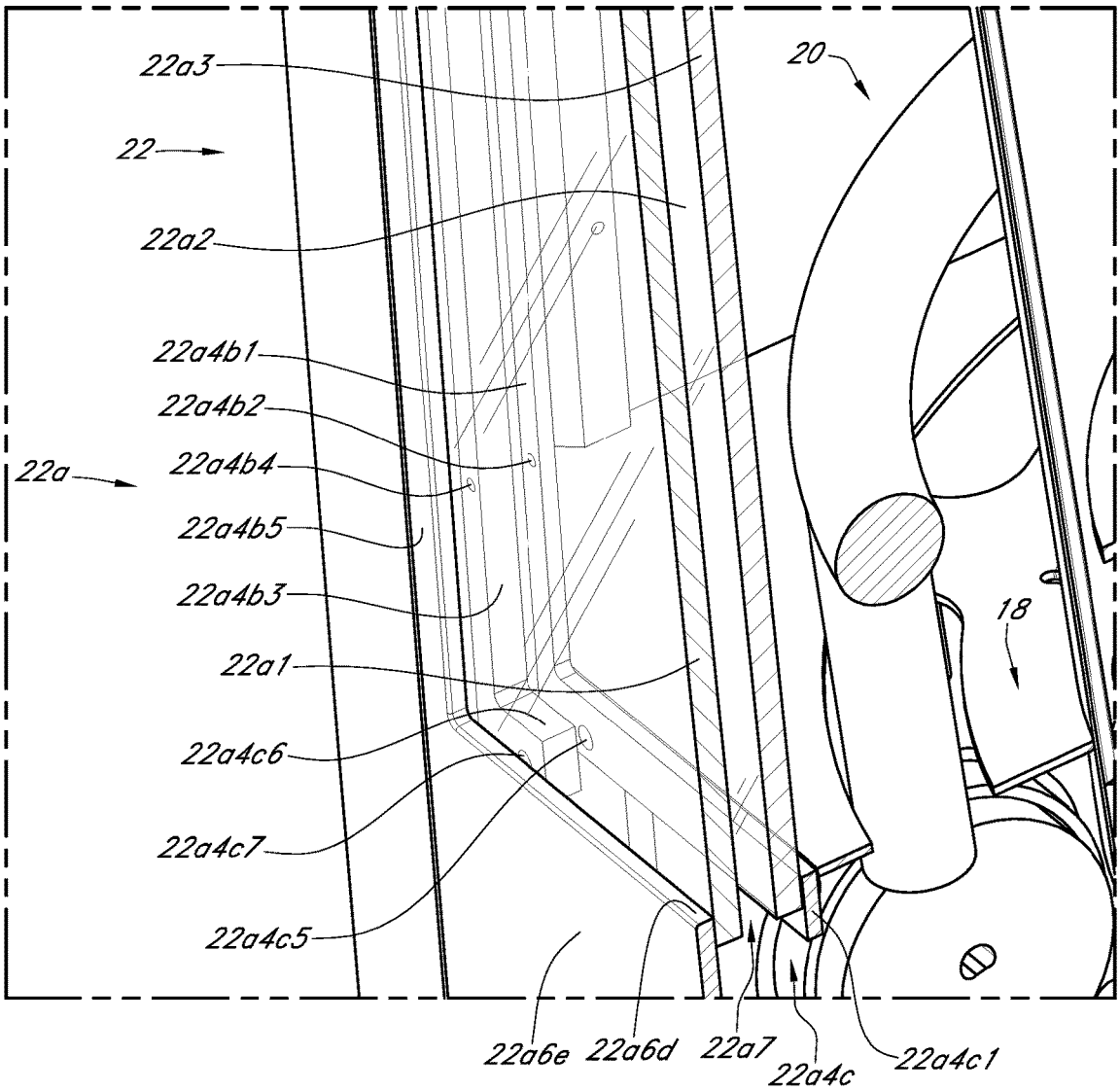

Turning to FIG. 13, depicted therein is an enlarged perspective view showing aspects of the first implementation of the enhanced heater system 28 (e.g. see, FIG. 12) including aspects of support plate assembly 18, burner assembly 20, and enclosure assembly 22.

In implementations, enclosure assembly 22 is shown in FIG. 13 to include support pin aperture 22*a*4*b*2 and support pin aperture 22*a*4*b*4, which are included in vertical side portion 22*a*4*b* (see FIG. 10A) In implementations, enclosure assembly 22 is shown in FIG. 13 to include side aperture portion 22*a*4*c* which is included in window pane assembly 22*a*4 (see FIG. 15). In implementations, side aperture portion 22*a*4*c* is shown to include horizontal frame member 22*a*4*c*1, support pin aperture 22*a*4*c*5, intermediate channel wall 22*a*4*c*6, and support pin aperture 22*a*4*c*7. In implementations, enclosure assembly 22 is shown in FIG. 13 to include exterior lower panel edge 22*a*6*d* which is included in exterior lower panel 22*a*6 (see FIG. 15).

Figure 14:
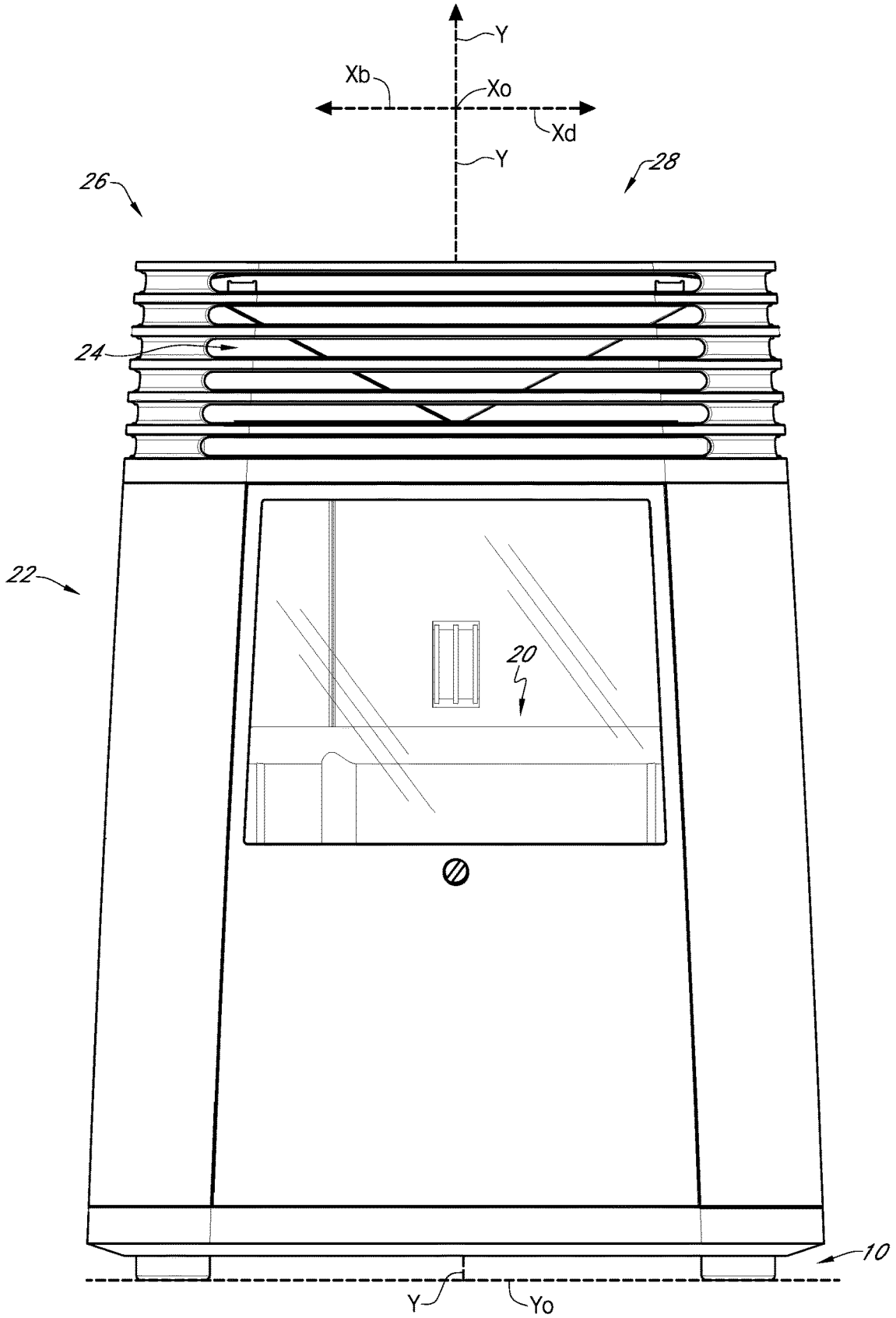
FIG. 14 is a side elevational view showing aspects of the first implementation of the enhanced heating system as fully assembled including aspects of baseplate assembly, burner assembly, enclosure assembly, pyramidal deflector assembly, and top enclosure assembly.

Turning to FIG. 14, depicted therein is a side elevational view showing aspects of the first implementation of the enhanced heater system 28 as fully assembled including aspects of baseplate assembly 10, burner assembly 20, enclosure assembly 22, pyramidal deflector assembly 24, and top enclosure assembly 26.

Turning to FIG. 15 depicted therein is a perspective view showing aspects of the first implementation of the enhanced heater system 28 (e.g. see, FIG. 12) including aspects of enclosure assembly 22.

In implementations, enclosure assembly 22 is shown in FIG. 15 to include window pane assembly 22*a*4 and exterior lower panel 22*a*6 which are included in side assembly movable 22*a* (see FIG. 10). In implementations, window pane assembly 22*a*4, is shown to include side portion 22*a*4*a*, side portion 22*a*4*d*, and window aperture 22*a*4*e*. In implementations, exterior lower panel 22*a*6 is shown to include side portion 22*a*6*a*, side portion 22*a*6*b*, and side portion 22*a*6*c*.

Figure 15A:
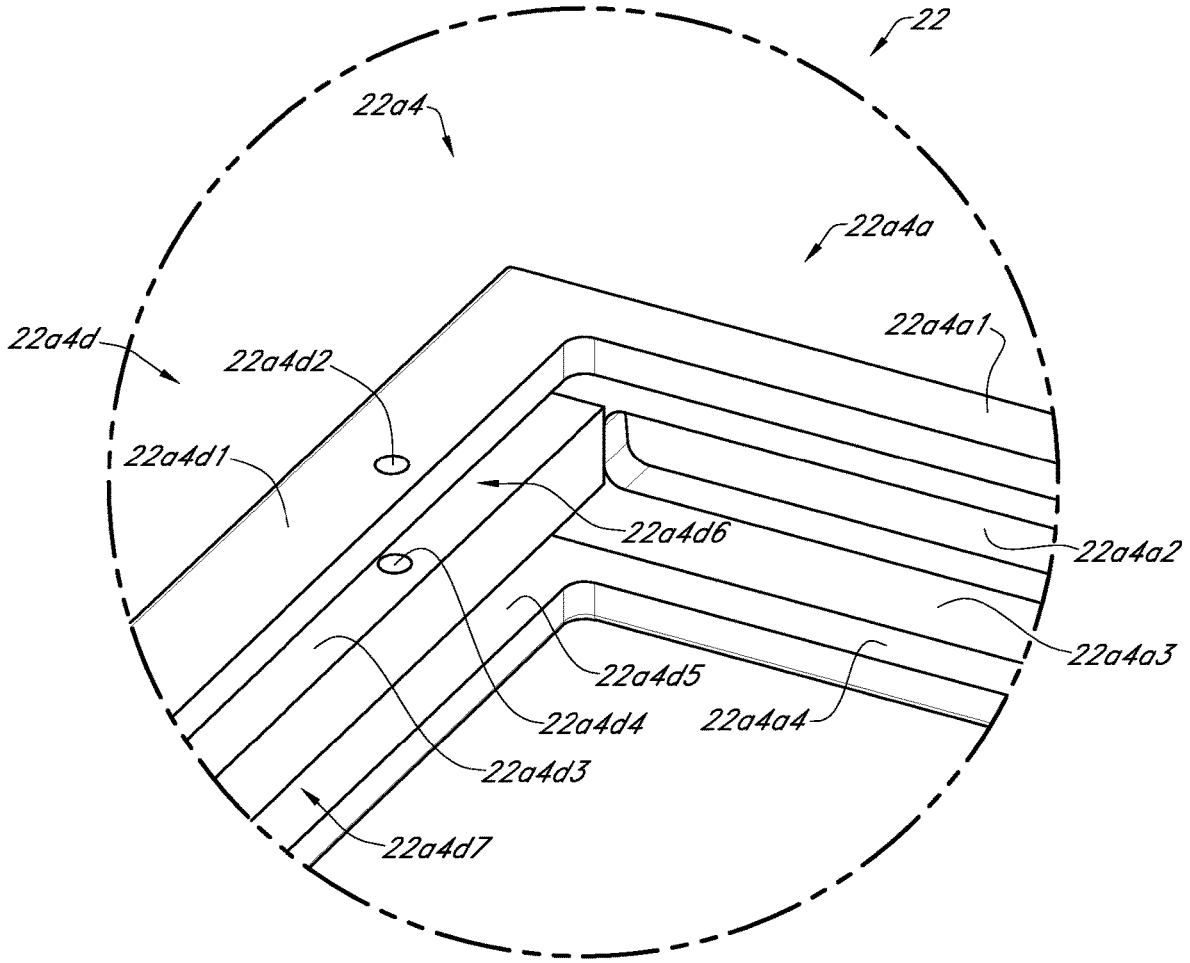
FIG. 15A is an enlarged portion of the perspective view of FIG. 15 showing aspects of the first implementation of the enhanced heating system including aspects of enclosure assembly.

Turning to FIG. 15A, depicted therein is an enlarged portion of the perspective view of FIG. 15 showing aspects of the first implementation of the enhanced heater system 28 (e.g. see, FIG. 12) including aspects of enclosure assembly 22.

In implementations, enclosure assembly 22 is shown in FIG. 15A to include horizontal frame member 22*a*4*a*1, elongated aperture 22*a*4*a*2, pane support ledge 22*a*4*a*3, and horizontal frame member 22*a*4*a*4, which are included in side portion 22*a*4*a* (see FIG. 15). In implementations, enclosure assembly 22 is shown in FIG. 15A to include support pin aperture 22*a*4*d*2, support pin aperture 22*a*4*d*4, and window pane channel 22*a*4*d*6 which are included in side portion 22*a*4*d* (see FIG. 15).

Figure 15B:
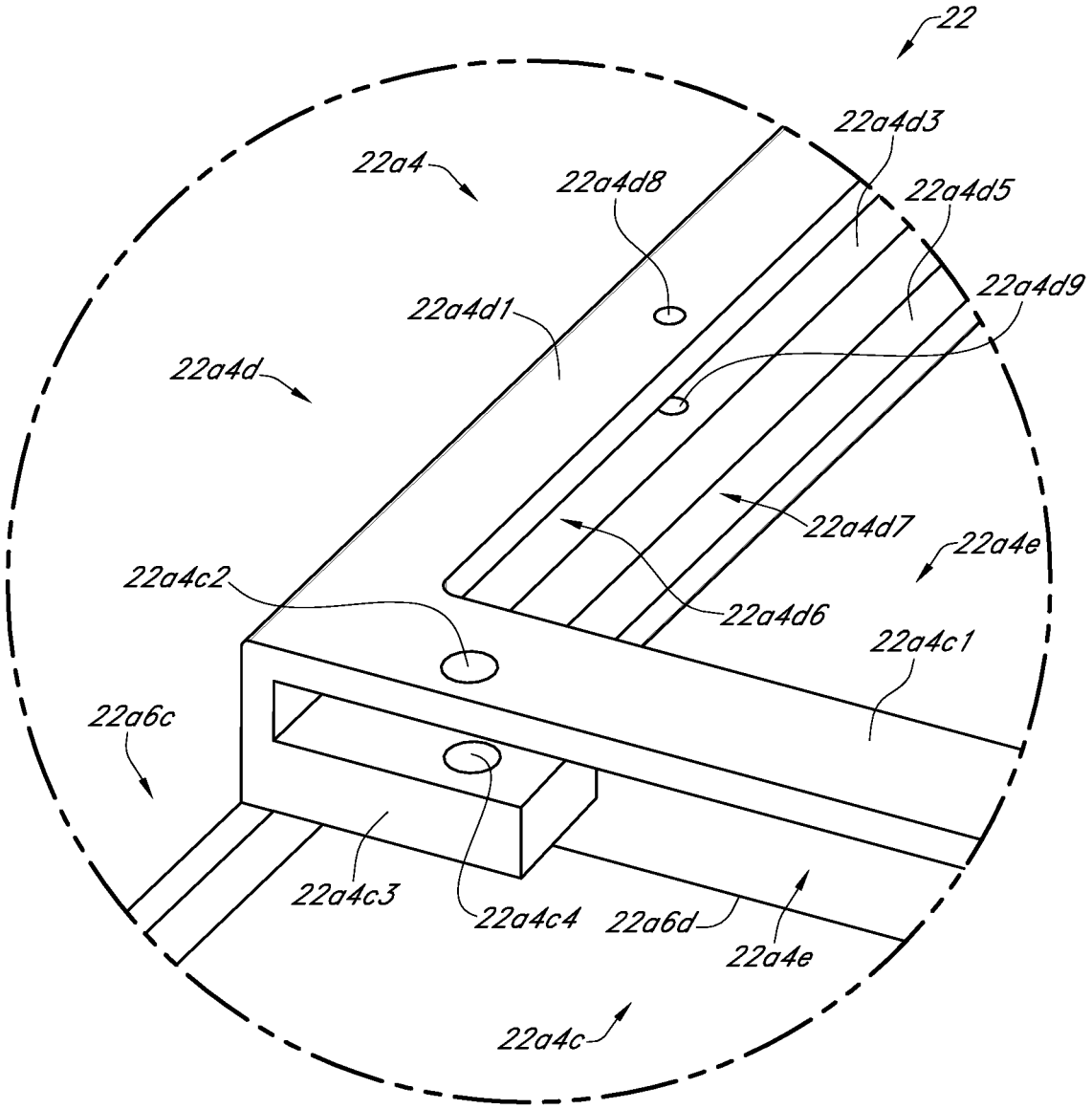
FIG. 15B is an enlarged portion of the perspective view of FIG. 15 showing aspects of the first implementation of the enhanced heating system including aspects of enclosure assembly.

Turning to FIG. 15B, depicted therein is an enlarged portion of the perspective view of FIG. 15 showing aspects of the first implementation of the enhanced heater system 28 (e.g. see, FIG. 12) including aspects of enclosure assembly 22.

In implementations, enclosure assembly 22 is shown in FIG. 15B to include support pin aperture 22*a*4*c*2, intermediate channel wall 22*a*4*c*3, and support pin aperture 22*a*4*c*4 which are included in side aperture portion 22*a*4*c* (see FIG. 13). In implementations, enclosure assembly 22 is shown in FIG. 15B to include window pane channel 22*a*4*d*7, support pin aperture 22*a*4*d*8, support pin aperture 22*a*4*d*9, which are included in side portion 22*a*4*d* (see FIG. 15).

Figure 16:
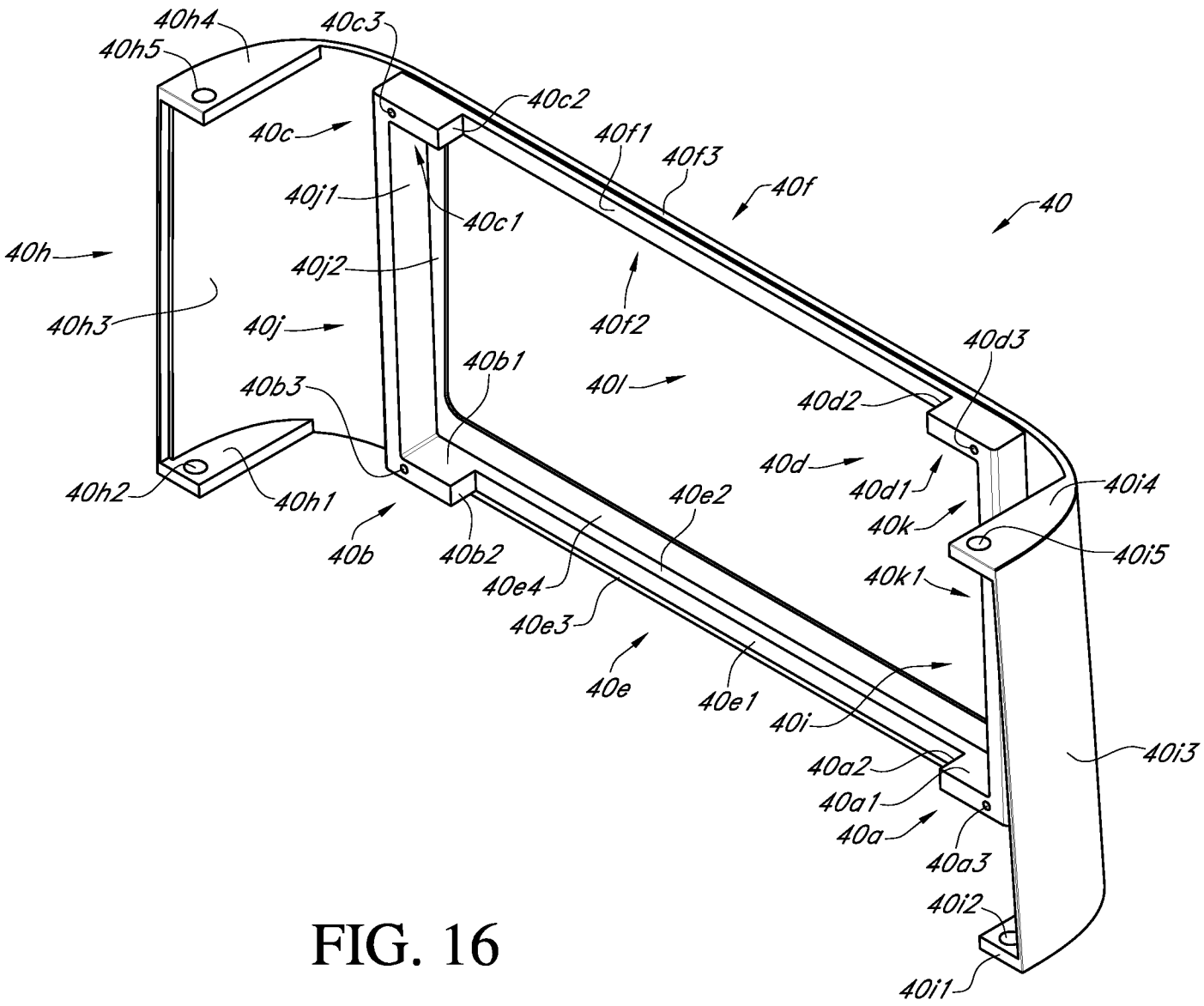
FIG. 16 is a perspective view showing aspects of a second implementation of an enhanced heating system including aspects of front pane frame assembly.

Turning to FIG. 16, depicted therein is a perspective view showing aspects of a second implementation of an enhanced heating system 70 (e.g. see, FIG. 29) including aspects of front pane frame assembly 40.

In implementations, front pane frame assembly 40 is shown to include frame corner portion 40*a*, frame corner portion 40*b*, frame corner portion 40*c*, frame corner portion 40*d*, horizontal frame portion 40*e*, horizontal frame portion 40*f*, side engagement structure 40*h*, side engagement structure 40*i*, vertical frame portion 40*j*, vertical frame portion 40*k*, and exterior pane aperture 401. In implementations, frame corner portion 40*a* is shown to include pane edge contact surface 40*a*1, aperture edge portion 40*a*2, and coupling point 40*a*3. In implementations, frame corner portion 40*b* is shown to include pane edge contact surface 40*b*1, aperture edge portion 40*b*2, and coupling point 40*b*3. In implementations, frame corner portion 40*c* is shown to include pane edge contact surface 40*c*1, aperture edge portion 40*c*2, and coupling point 40*c*3. In implementations, frame corner portion 40*d* is shown to include page edge contact surface 40*d*1, aperture edge portion 40*d*2, and coupling point 40*d*3. In implementations, horizontal frame portion 40*e* is shown to include aperture edge portion 40*e*1, pane edge contact surface 40*e*2, bottom frame edge 40*e*3, and pane contact surface 40*e*4. In implementations, horizontal frame portion 40*f* is shown to include aperture edge portion 40*f*1, pane edge contact surface 40*f*2, and top frame edge 40*f*3. In implementations, side engagement structure 40*h* is shown to include horizontal lip member 40*h*1, coupling point 40*h*2, vertical side portion 40*h*3, horizontal lip member 40*h*4, and coupling point 40*h*5. In implementations, side engagement structure 40*i* is shown to include horizontal lip member 40*i*1, coupling point 40*i*2, vertical side portion 40*i*3, horizontal lip member 40*i*4, and coupling point 40*i*5. In implementations, vertical frame portion 40*j* is shown to include pane edge contact surface 40*j*1 and pane face contact surface 40*j*2. In implementations, vertical frame portion 40*k* is shown to include pane edge contact surface 40*k*1.

Figure 17:
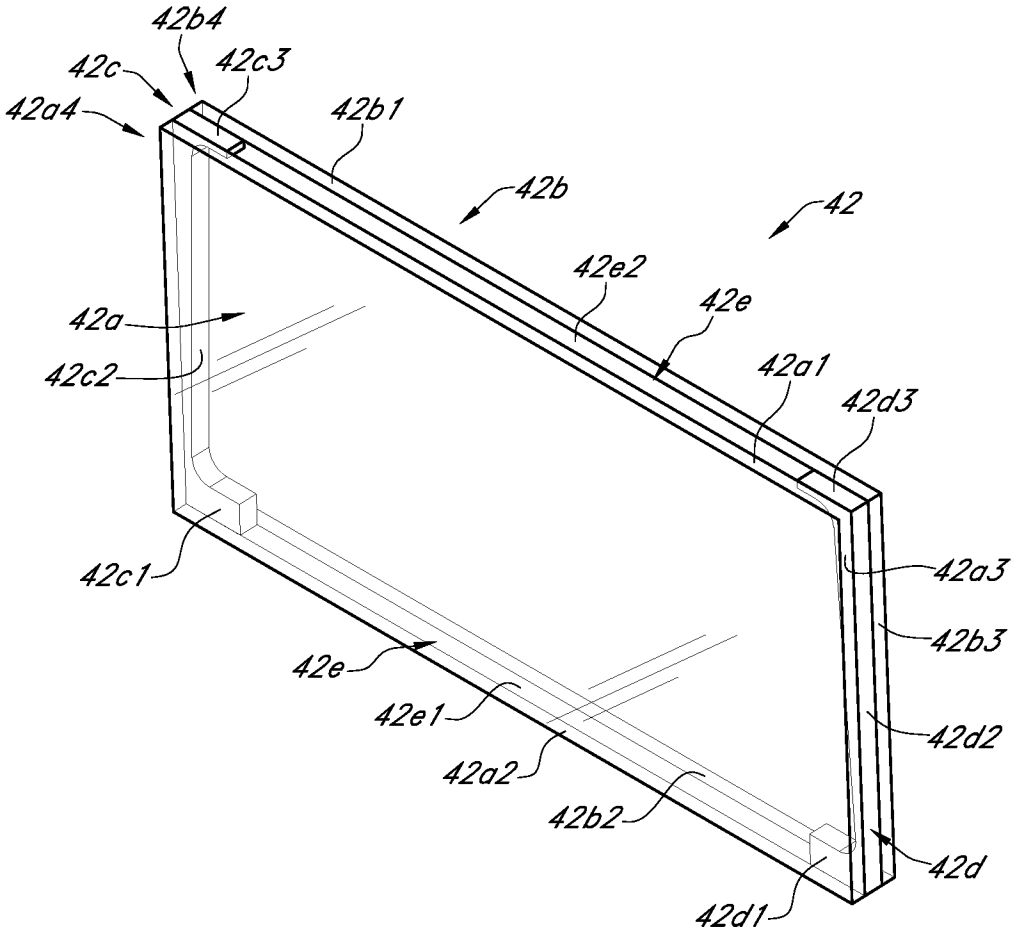
FIG. 17 is a perspective view showing aspects of the second implementation of the enhanced heating system including aspects of window pane assembly.

Turning to FIG. 17, depicted therein is a perspective view showing aspects of the second implementation of the enhanced heating system 70 (e.g. see, FIG. 29) including aspects of window pane assembly 42.

In implementations, window pane assembly 42 is shown to include interior window pane 42*a*, exterior window pane 42*b*, pane spacer member 42*c*, pane spacer member 42*d*, and intermediate pane gap 42*e*. In implementations, interior window pane 42*a* is shown to include upper horizontal edge 42*a*1, lower horizontal edge 42*a*2, vertical edge 42*a*3, and vertical edge 42*a*4. In implementations, exterior window pane 42*b* is shown to include upper horizontal edge 42*b*1, lower horizontal edge 42*b*2, vertical edge 42*b*3, and vertical edge 42*b*4. In implementations, pane spacer member 42*c* is shown to include lower horizontal portion 42*c*1, vertical portion 42*c*2, and upper horizontal portion 42*c*3. In implementations, pane spacer member 42*d* is shown to include lower horizontal portion 42*d*1, vertical portion 42*d*2, and upper horizontal portion 42*d*3. In implementations, intermediate pane gap 42*e* is shown to include lower pane gap aperture 42*e*1 and upper pane gap aperture 42*e*2.

Figure 18:
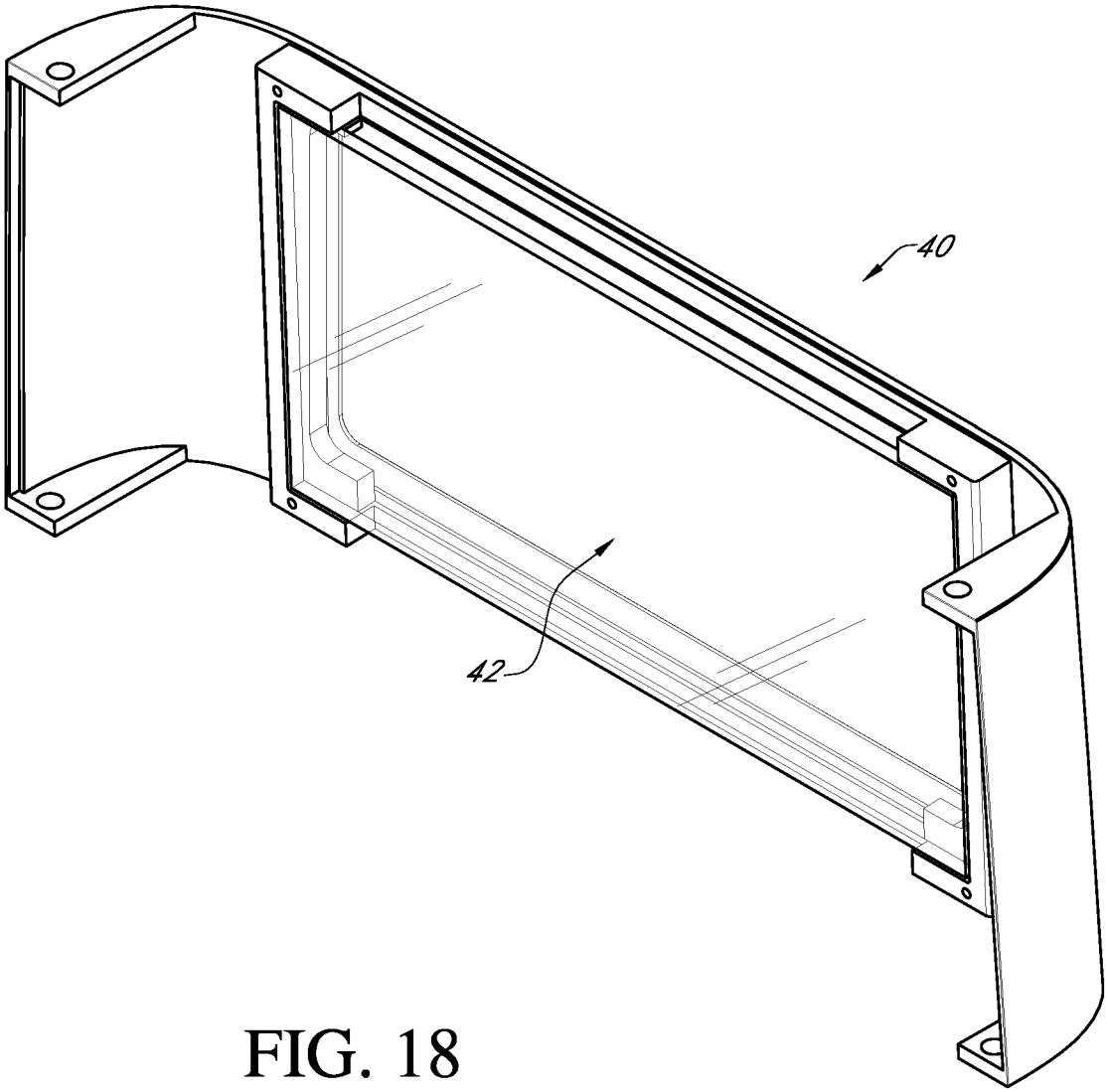
FIG. 18 is a perspective view showing aspects of the second implementation of the enhanced heating system including aspects of front pane frame assembly and window pane assembly.

Turning to FIG. 18, depicted therein is a perspective view showing aspects of the second implementation of the enhanced heating system 70 (e.g. see, FIG. 29) including aspects of front pane frame assembly 40 and window pane assembly 42.

Figure 19:
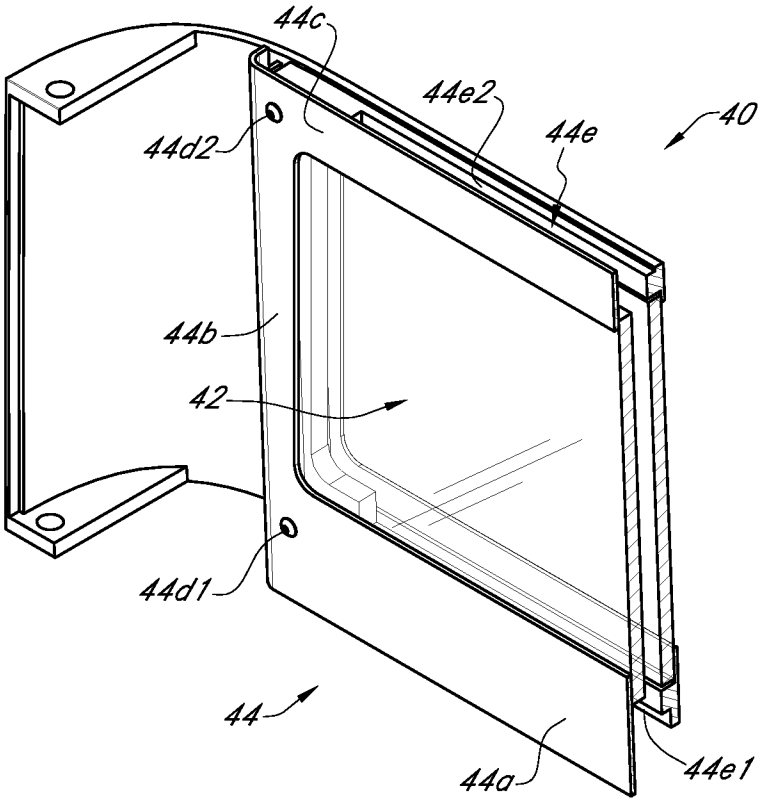
FIG. 19 is a cross-sectional perspective view showing aspects of the second implementation of the enhanced heating system including aspects of front pane frame assembly, window pane assembly and rear pane frame assembly.

Turning to FIG. 19, depicted therein is a cross-sectional perspective view showing aspects of the second implementation of the enhanced heating system 70 (e.g. see, FIG. 29) including aspects of front pane frame assembly 40, window pane assembly 42 and rear pane frame assembly 44.

In implementations, rear pane frame assembly 44 is shown to include lower horizontal portion 44*a*, vertical portion 44*b*, upper horizontal portion 44*c*, lower coupling point 44*d*1, upper coupling point 44*d*2, intermediate pane gap 44*e*. In implementations, intermediate pane gap 44*e* is shown to include lower intermediate gap aperture 44*e*1 and upper intermediate gap aperture 44*e*2.

Figure 20:
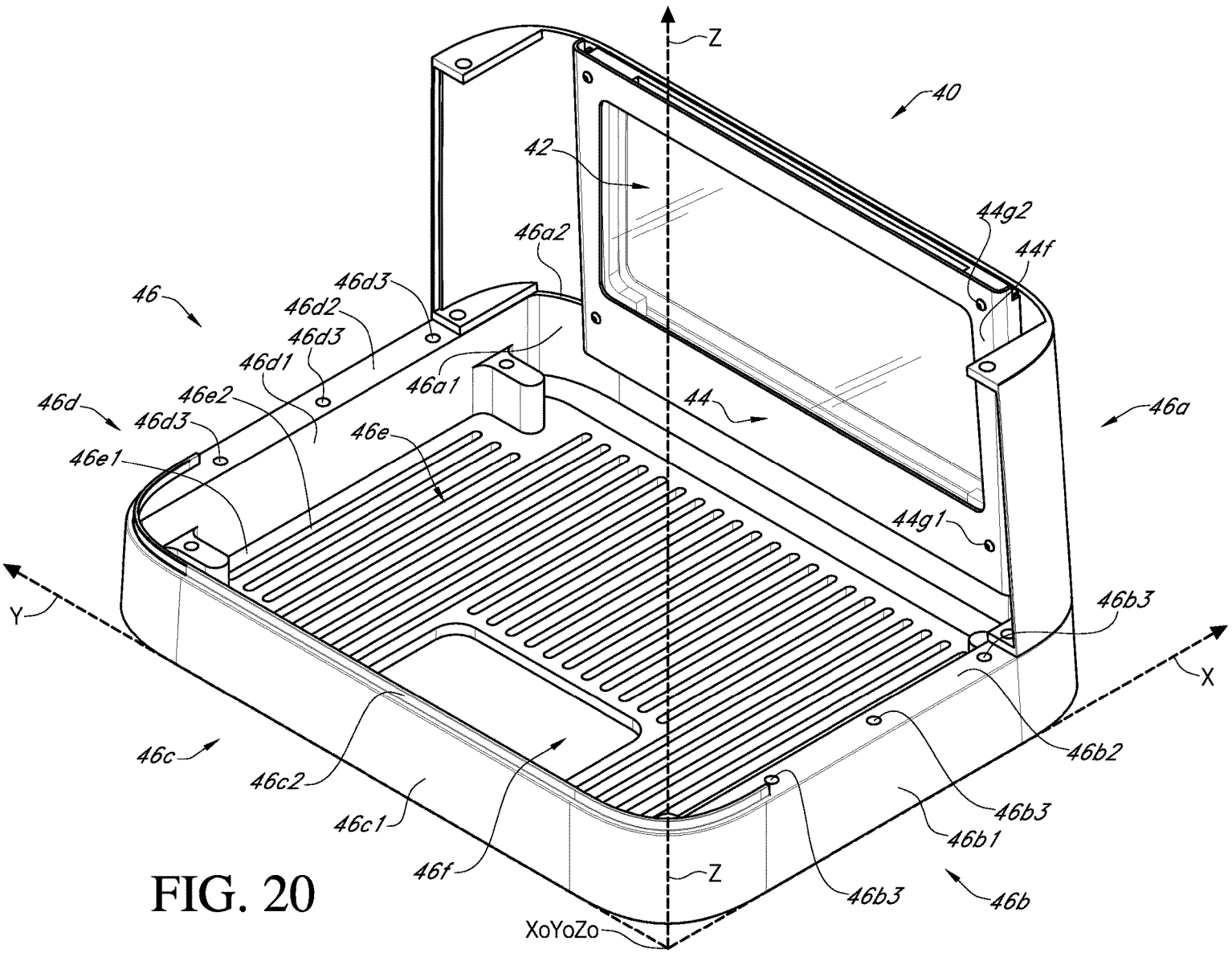
FIG. 20 is a perspective view showing aspects of the second implementation of the enhanced heating system including aspects of front pane frame assembly, window pane assembly, rear pane frame assembly, and base assembly.

Turning to FIG. 20, depicted therein is a perspective view showing aspects of the second implementation of the enhanced heating system 70 (e.g. see, FIG. 29) including aspects of front pane frame assembly 40, window pane assembly 42, rear pane frame assembly 44, and base assembly 46; and depicted to use horizontal axis X, horizontal axis Y, vertical axis Z, and axes origin XoYoZo.

In implementations, rear pane frame assembly 44 is shown in FIG. 20 to include vertical portion 44*f*, lower coupling point 44*g*1, and upper coupling point 44*g*2. In implementations, base assembly 46 is shown to include side portion 46*a*, side portion 46*b*, side portion 46*c*, side portion 46*d*, baseplate portion 46*e*, and enlarged aperture 46*f*. In implementations, side portion 46*a* is shown to include vertical wall 46*a*1 and horizontal upper surface 46*a*2. In implementations, side portion 46*b* is shown to include vertical wall 46*b*1, horizontal upper surface 46*b*2, and coupling point 46*b*3. In implementations, side portion 46*c* is shown to include vertical wall 46*c*1 and horizontal upper surface 46*c*2. In implementations, side portion 46*d* is shown to include vertical wall 46*d*1, horizontal upper surface 46*d*2, and coupling point 46*d*3. In implementations, baseplate portion 46*e* is shown to include horizontal upper surface 46*e*1 and elongated aperture 46*e*2.

Figure 21:
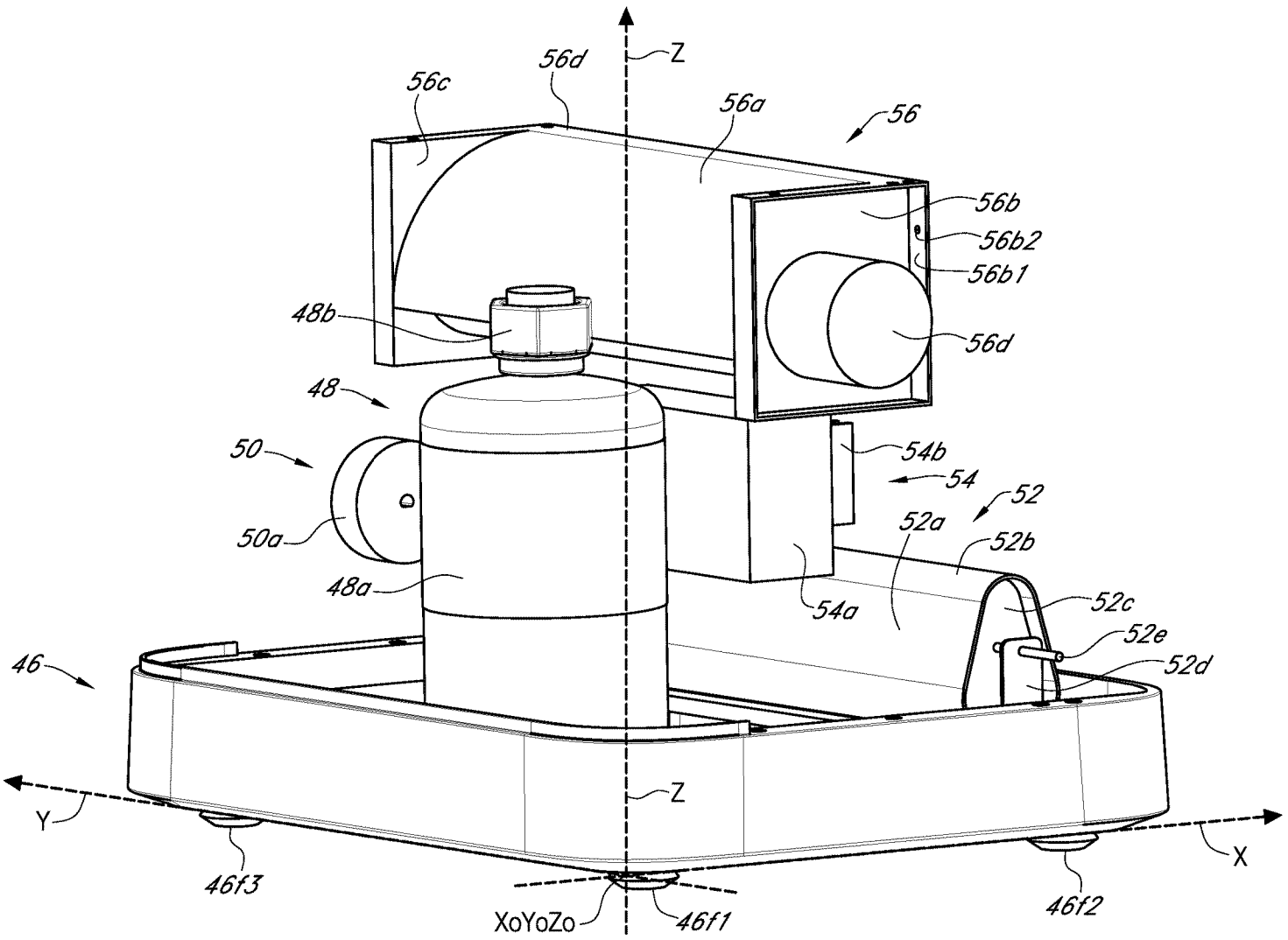
FIG. 21 is a perspective view showing aspects of the second implementation of the enhanced heating system including aspects of base assembly, gaseous fuel storage, control assembly, and burner assembly, Seebeck thermoelectric generator assembly and horizontal-axis elongated fan assembly.

Turning to FIG. 21, depicted therein is a perspective view showing aspects of the second implementation of the enhanced heating system 70 (e.g. see, FIG. 29) including aspects of base assembly 46, gaseous fuel storage 48, control assembly 50, and burner assembly 52, Seebeck thermoelectric generator assembly 54 and horizontal-axis elongated fan assembly 56.

In implementations, base assembly 46 is shown in FIG. 21 to include foot member 46*f*1, foot member 46*f*2, and foot member 46f3, which are included in enlarged aperture 46f (see FIG. 20). In implementations, gaseous fuel storage 48 is shown to include fuel bottle 48a and coupling member 48b. In implementations, control assembly 50 is shown to include control knob 50a. In implementations, burner assembly 52 is shown to include canted wall 52a, flame discharge member 52b, end support wall 52c, bracket portion 52d, and support rod 52e. In implementations, Seebeck thermoelectric generator assembly 54 is shown to include cool-air heat exchanger 54a and warm-air heat exchanger 54b. In implementations, horizontal-axis elongated fan assembly 56 is shown to include hood deflector member 56a, vertical end plate 56b, vertical end plate 56c, and motor 56d. In implementations, vertical end plate 56b is shown to include mounting edge member 56b1 and coupling point 56b2.

Figure 22:
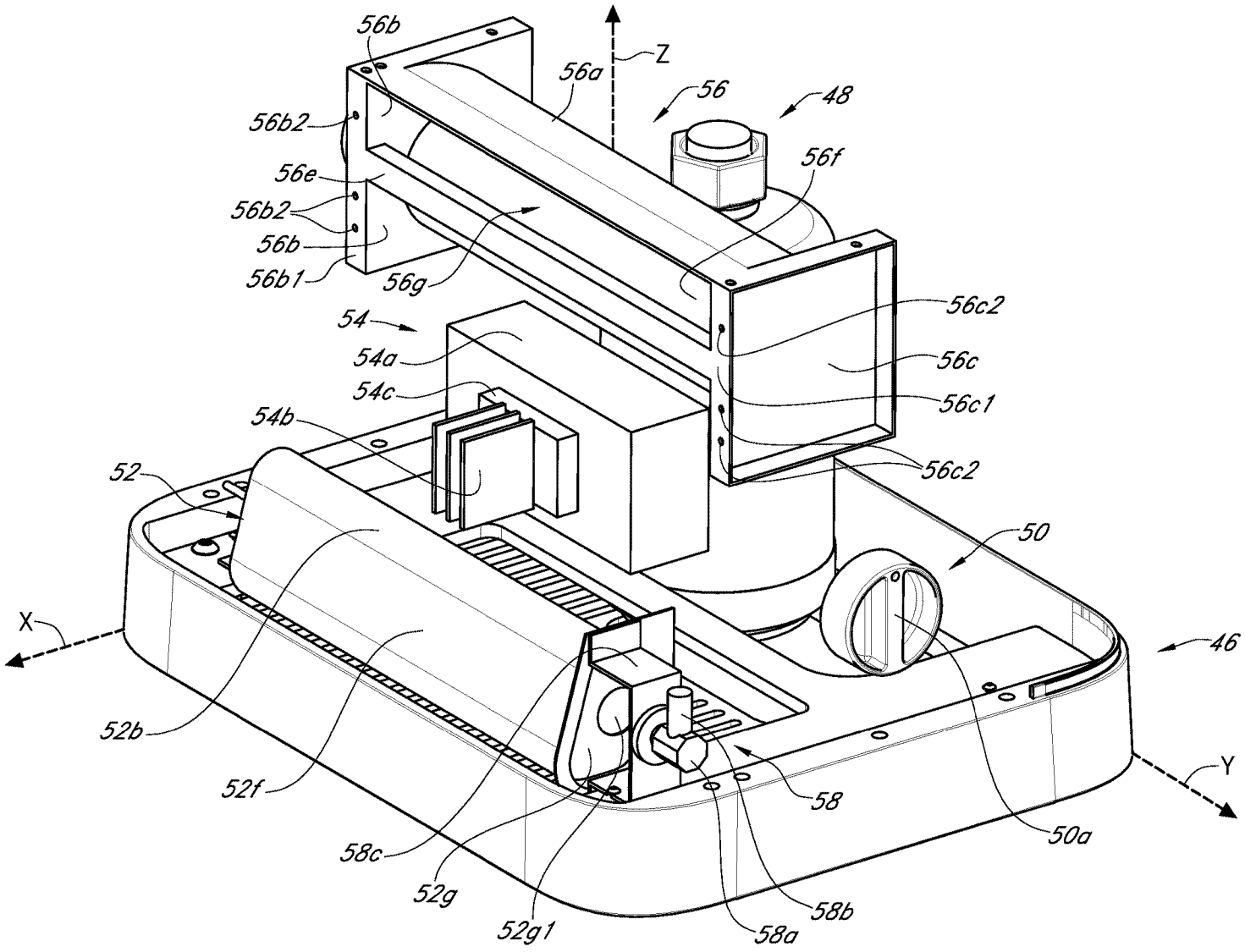
FIG. 22 is a perspective view showing aspects of the second implementation of the enhanced heating system including aspects of base assembly, gaseous fuel storage, control assembly, burner assembly, Seebeck thermoelectric generator assembly, horizontal-axis elongated fan assembly, and gas nozzle assembly.

Turning to FIG. 22, depicted therein is a perspective view showing aspects of the second implementation of the enhanced heating system 70 (e.g. see, FIG. 29) including aspects of base assembly 46, gaseous fuel storage 48, control assembly 50, burner assembly 52, Seebeck thermoelectric generator assembly 54, horizontal-axis elongated fan assembly 56, and gas nozzle assembly 58. Similarly to aspects of enhanced heater system 28 (e.g. see, FIG. 9), aspects of enhanced heating system 70 include control assembly 50 being gas plumbed (not shown) to gaseous fuel storage 48 and gas nozzle assembly 58 with one or more valve(s) and control(s) (not shown) and electrically wired to one or more igniters, and thermocouples or other sensors positioned above burner assembly 52 (not shown) to provide initiation and regulation of fuel burn by burner assembly 52. Included in this control can be functions which regulate fan operation and speed based upon whether burner assembly 52 is burning. For instance, if no fuel is being burned fan operation can be stopped or not initiated.

In implementations, burner assembly 52 is shown in FIG. 22 to include canted wall 52f and end support wall 52g. In implementations, end support wall 52g is shown to include gas aperture 52g1. In implementations, Seebeck thermoelectric generator assembly 54 is shown in FIG. 22 to include Seebeck thermoelectric generator electronics portion 54c. In implementations, horizontal-axis elongated fan assembly 56 is shown in FIG. 22 to include mounting edge member 56c1 and coupling point 56c2 which are included in vertical end plate 56c (see FIG. 21). In implementations, horizontal-axis elongated fan assembly 56 is shown in FIG. 22 to include horizontal frame member 56e, horizontal-axis elongated fan blade 56f, and horizontal exit aperture 56g. In implementations, gas nozzle assembly 58 is shown to include nozzle member 58a, coupling member 58b, and support bracket member 58c.

Figure 23:
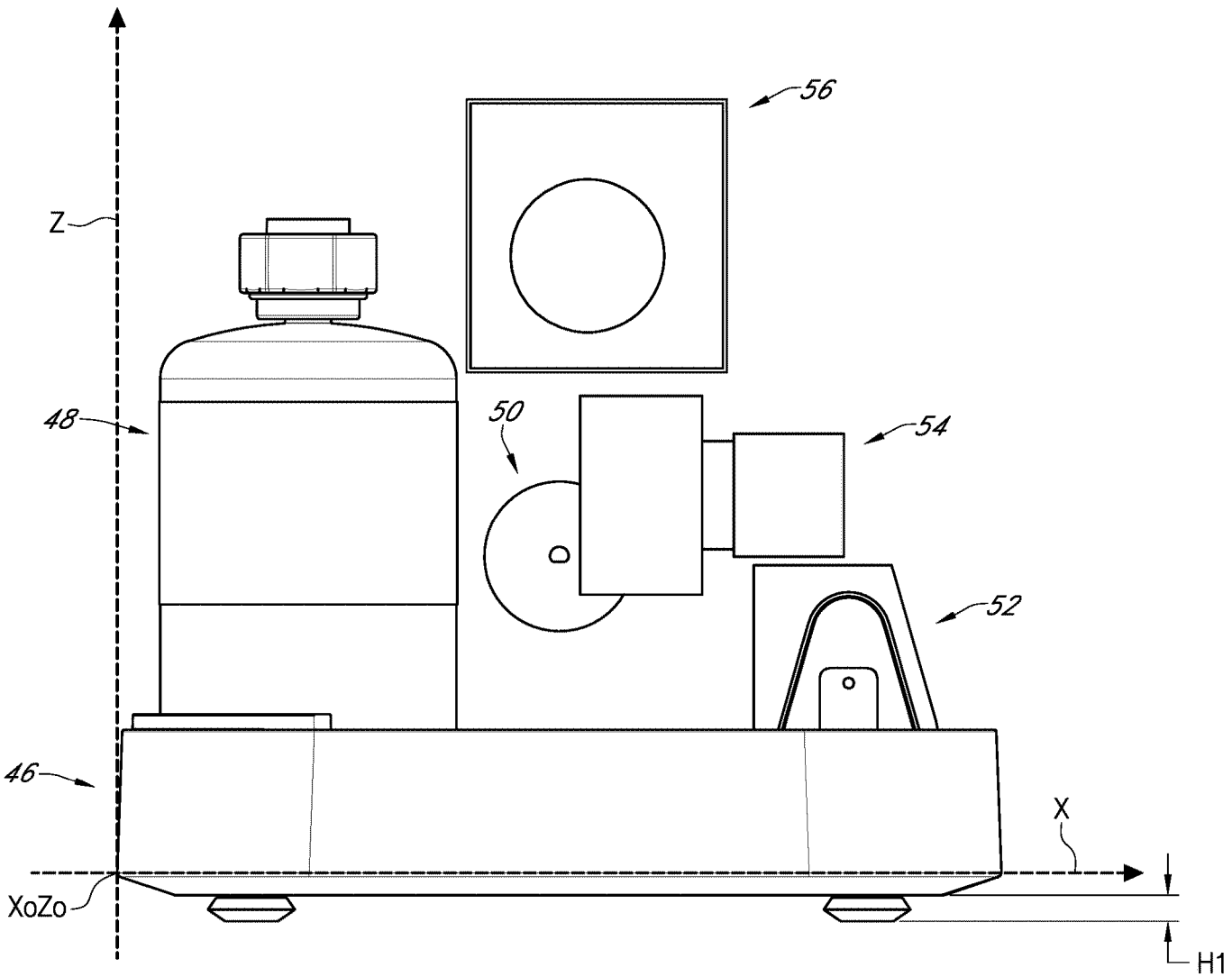
FIG. 23 is a side elevational view showing aspects of the second implementation of the enhanced heating system including aspects of base assembly, gaseous fuel storage, control assembly, burner assembly, Seebeck thermoelectric generator assembly, and horizontal-axis elongated fan assembly.

Turning to FIG. 23, depicted therein is a side elevational view showing aspects of the second implementation of the enhanced heating system 70 (e.g. see, FIG. 29) including aspects of base assembly 46, gaseous fuel storage 48, control assembly 50, burner assembly 52, Seebeck thermoelectric generator assembly 54 and horizontal-axis elongated fan assembly 56 and depicted to use origin of axes XoZo and height dimension H1, which can be at least an inch to allow for sufficient airflow into the enhanced heating system.

Figure 24:
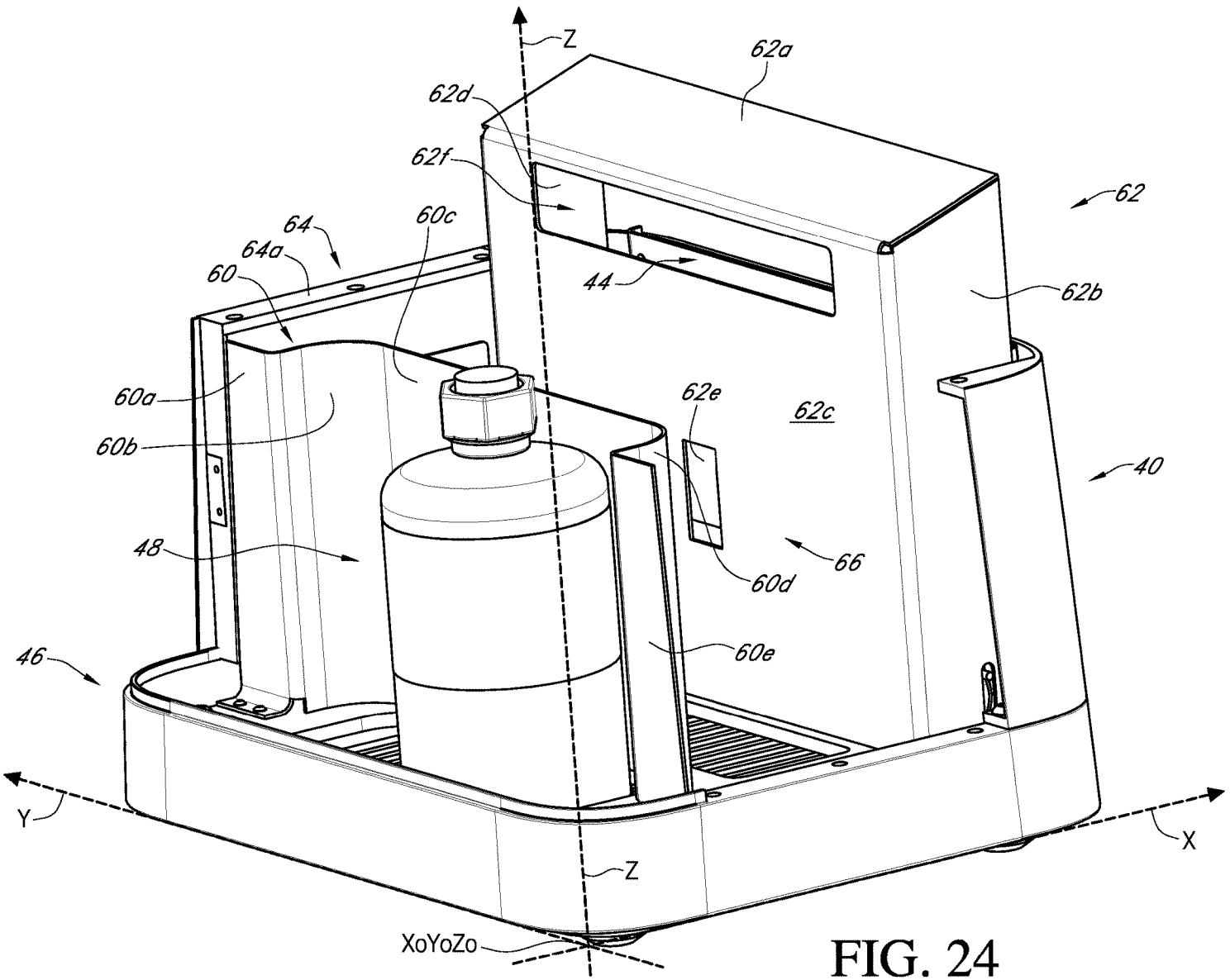
FIG. 24 is a perspective view showing aspects of the second implementation of the enhanced heating system including aspects of front pane frame assembly, rear pane frame assembly, base assembly, gaseous fuel storage, wall partition assembly, enclosure assembly, endwall assembly, and cooler-air partitioned space.

Turning to FIG. 24, depicted therein is a perspective view showing aspects of the second implementation of the enhanced heating system 70 (e.g. see, FIG. 29) including aspects of front pane frame assembly 40, rear pane frame assembly 44, base assembly 46, gaseous fuel storage 48, wall partition assembly 60, enclosure assembly 62, endwall assembly 64 and cooler-air partitioned space 66.

In implementations, wall partition assembly 60 is shown to include wall partition portion 60a, wall partition portion 60b, wall partition portion 60c, wall partition portion 60d, and wall partition portion 60e. In implementations, enclosure assembly 62 is shown to include rooftop member 62a, endwall member 62b, backwall member 62c, endwall member 62d, Seebeck thermoelectric generator aperture 62e, and horizontal fan aperture 62f. In implementations, endwall assembly 64 is shown to include horizontal coupling surface 64a.

Figure 25:
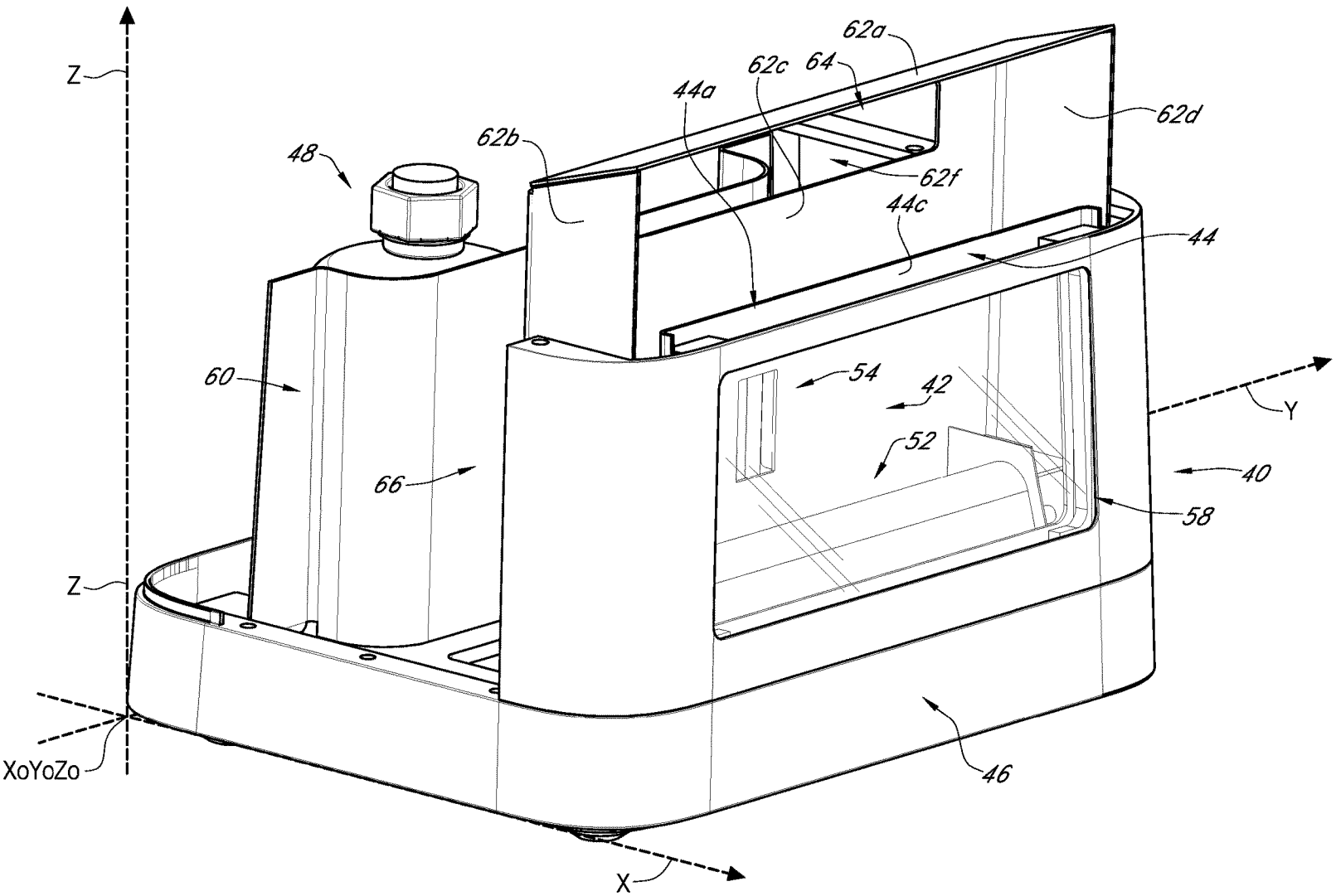
FIG. 25 is a perspective view showing aspects of the second implementation of the enhanced heating system including aspects of front pane frame assembly, window pane assembly, rear pane frame assembly, base assembly, gaseous fuel storage, burner assembly, Seebeck thermoelectric generator assembly, gas nozzle assembly, wall partition assembly, enclosure assembly, endwall assembly, and cooler-air partitioned space.

Turning to FIG. 25, depicted therein is a perspective view showing aspects of the second implementation of the enhanced heating system 70 (e.g. see, FIG. 29) including aspects of front pane frame assembly 40, window pane assembly 42, rear pane frame assembly 44, base assembly 46, gaseous fuel storage 48, burner assembly 52, Seebeck thermoelectric generator assembly 54, gas nozzle assembly 58, wall partition assembly 60, enclosure assembly 62, endwall assembly 64, and cooler-air partitioned space 66.

Figure 26:
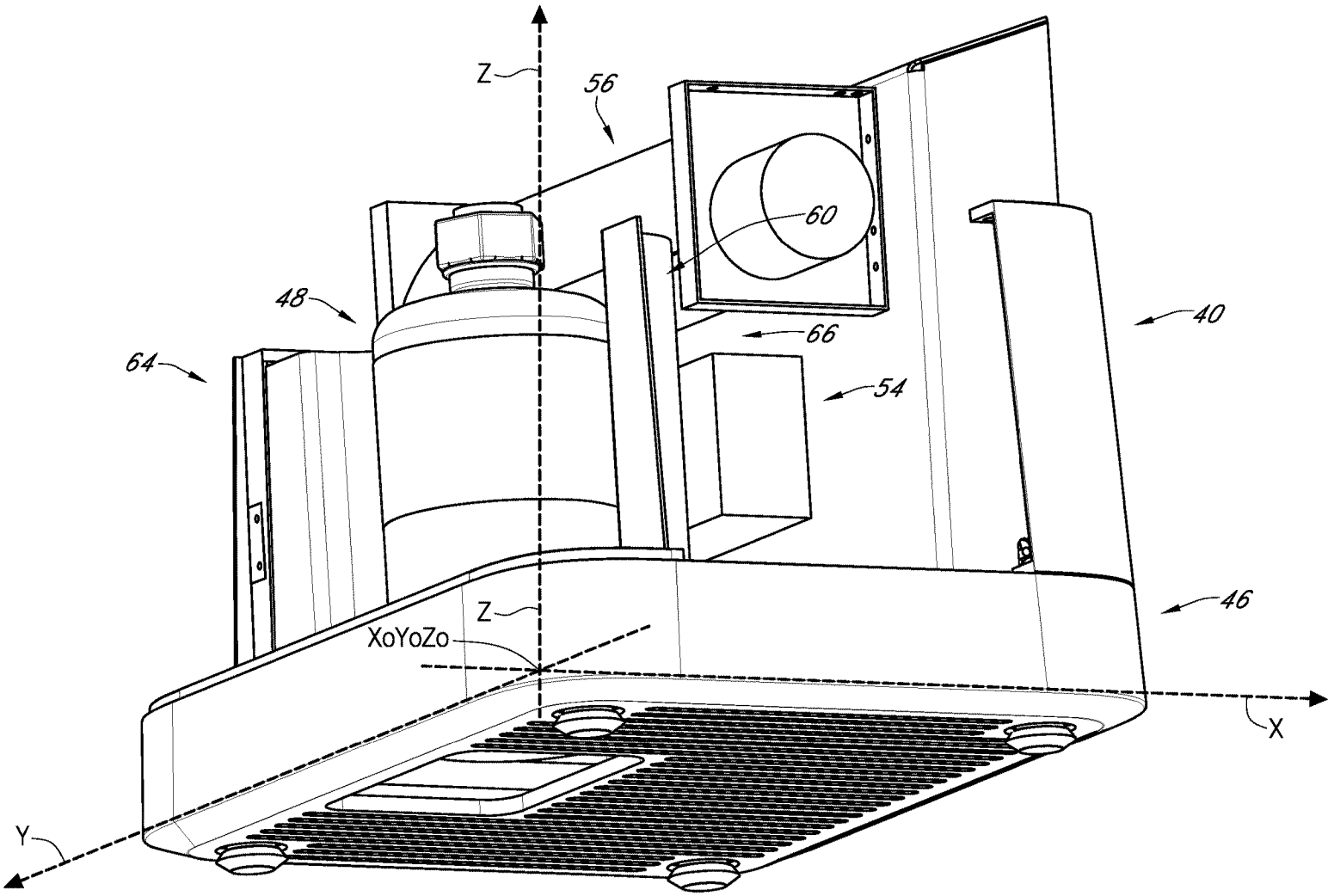
FIG. 26 is a perspective view showing aspects of the second implementation of the enhanced heating system including aspects of front pane frame assembly, base assembly, gaseous fuel storage, Seebeck thermoelectric generator assembly, wall partition assembly, enclosure assembly, endwall assembly, and cooler-air partitioned space.

Turning to FIG. 26, depicted therein is a perspective view showing aspects of the second implementation of the enhanced heating system 70 (e.g. see, FIG. 29) including aspects of front pane frame assembly 40, base assembly 46, gaseous fuel storage 48, base assembly 46, gaseous fuel storage 48, Seebeck thermoelectric generator assembly 54, wall partition assembly 60, enclosure assembly 62, endwall assembly 64, and cooler-air partitioned space 66.

Figure 27:
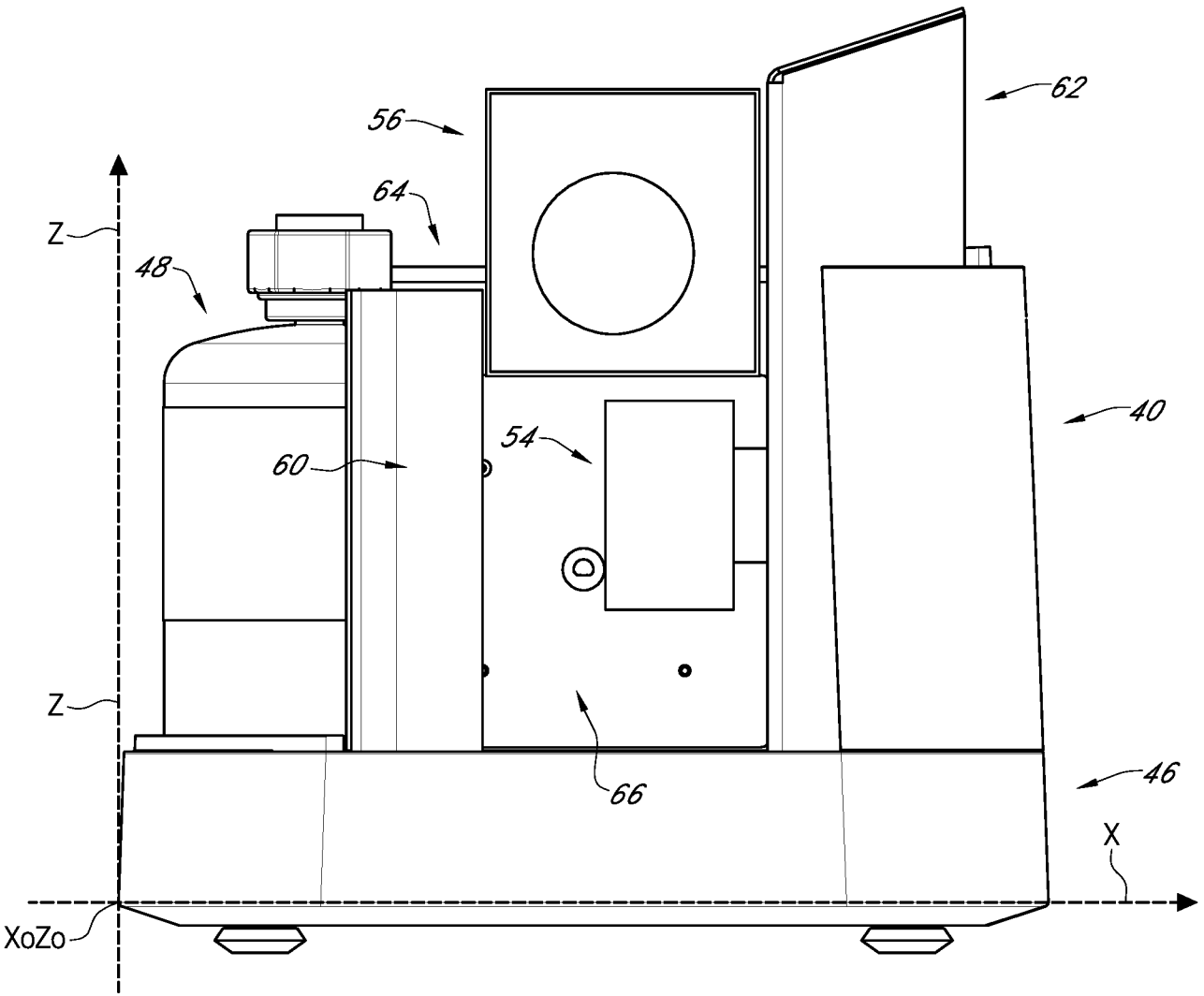
FIG. 27 is a side elevational view showing aspects of the second implementation of the enhanced heating system including aspects of front pane frame assembly, base assembly, gaseous fuel storage, Seebeck thermoelectric generator assembly, horizontal-axis elongated fan assembly, wall partition assembly, enclosure assembly, endwall assembly, and cooler-air partitioned space.

Turning to FIG. 27, depicted therein is a side elevational view showing aspects of the second implementation of the enhanced heating system 70 (e.g. see, FIG. 29) including aspects of front pane frame assembly 40, base assembly 46, gaseous fuel storage 48, Seebeck thermoelectric generator assembly 54, horizontal-axis elongated fan assembly 56, wall partition assembly 60, enclosure assembly 62, endwall assembly 64, and cooler-air partitioned space 66.

Figure 28:
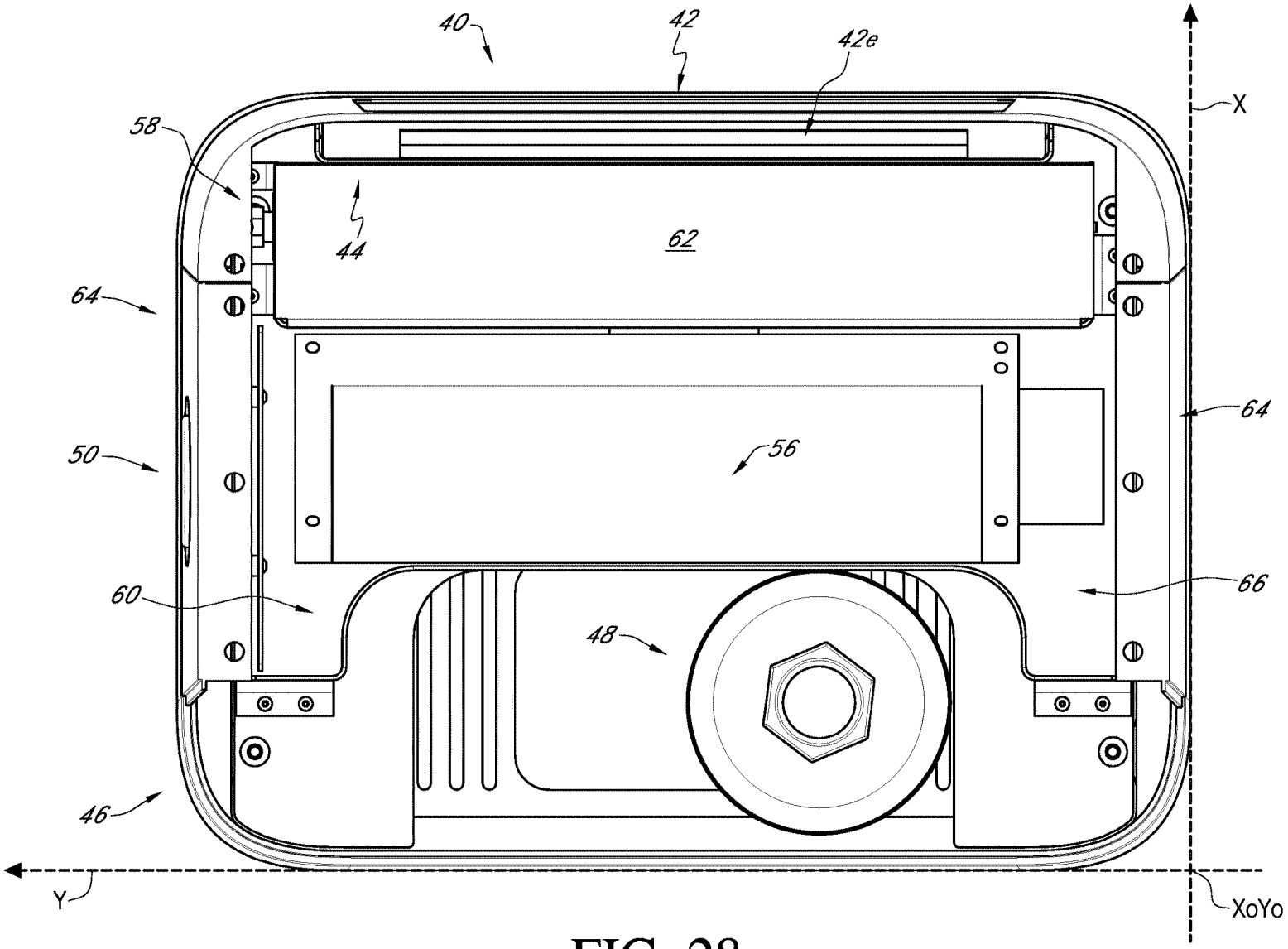
FIG. 28 is a top plan view showing aspects of the second implementation of the enhanced heating system including aspects of front pane frame assembly, window pane assembly, rear pane frame assembly, base assembly, gaseous fuel storage, control assembly, horizontal-axis elongated fan assembly, gas nozzle assembly, wall partition assembly, enclosure assembly, endwall assembly, and cooler-air partitioned space.

Turning to FIG. 28, depicted therein is a top plan view showing aspects of the second implementation of the enhanced heating system 70 (e.g. see, FIG. 29) including aspects of front pane frame assembly 40, window pane assembly 42, rear pane frame assembly 44, base assembly 46, gaseous fuel storage 48, control assembly 50, horizontal-axis elongated fan assembly 56, gas nozzle assembly 58, wall partition assembly 60, enclosure assembly 62, endwall assembly 64, and cooler-air partitioned space 66; and depicted to use origin of axes XoYo.

Figure 29:
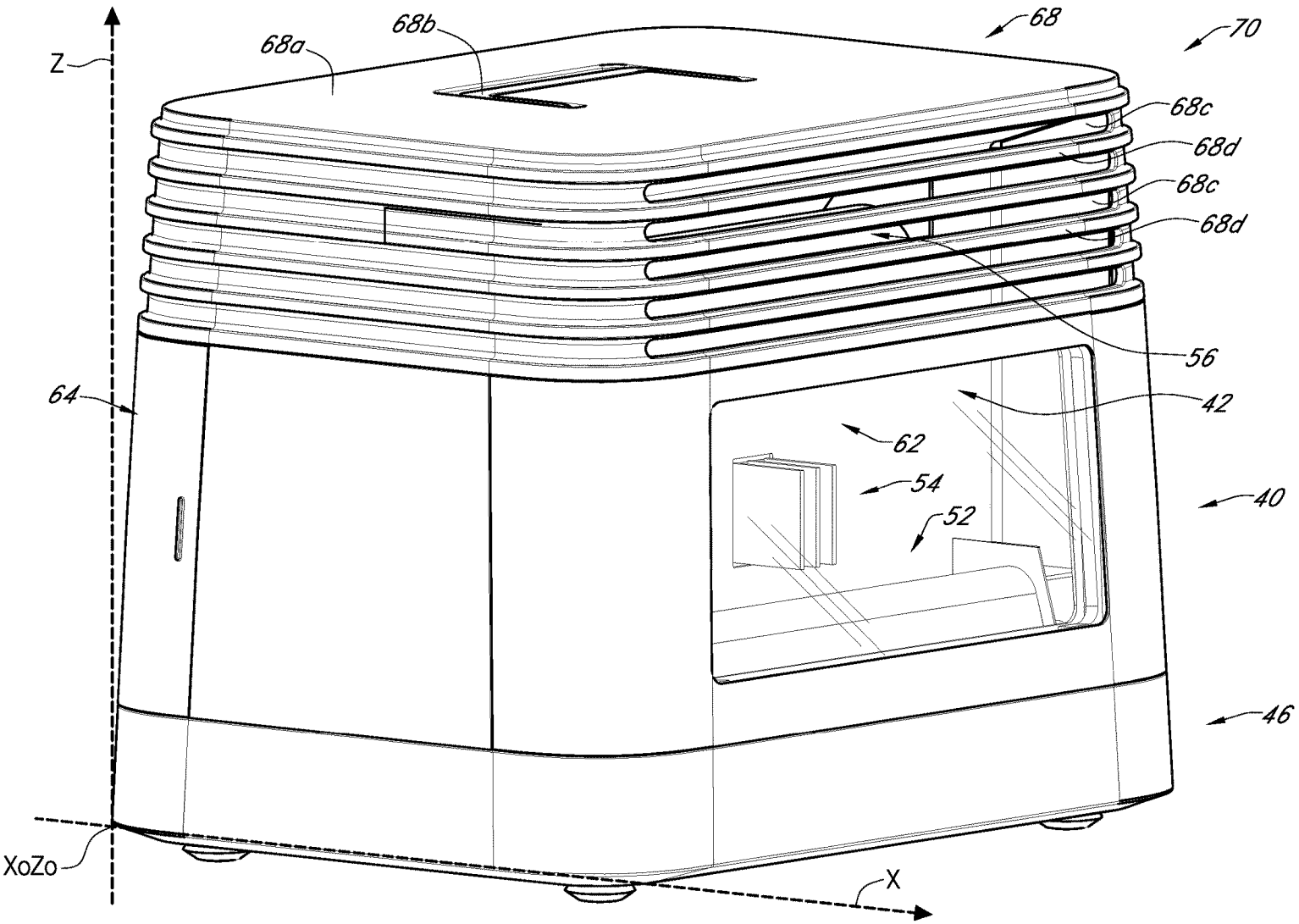
FIG. 29 is a perspective view showing aspects of the second implementation of the enhanced heating system as fully assembled including aspects of front pane frame assembly, window pane assembly, base assembly, burner assembly, Seebeck thermoelectric generator assembly, horizontal-axis elongated fan assembly, enclosure assembly, endwall assembly, and top enclosure assembly.

Turning to FIG. 29, depicted therein is a perspective view showing aspects of the second implementation of the enhanced heating system 70 as fully assembled including aspects of front pane frame assembly 40, window pane assembly 42, base assembly 46, base assembly 46, burner assembly 52, Seebeck thermoelectric generator assembly 54, horizontal-axis elongated fan assembly 56, enclosure assembly 62, endwall assembly 64, enclosure assembly 62, endwall assembly 64, and top enclosure assembly 68.

In implementations, top enclosure assembly 68 is shown to include top surface portion 68a, handle portion 68b, aperture portion 68c, and rib portion 68d.

Figure 30:
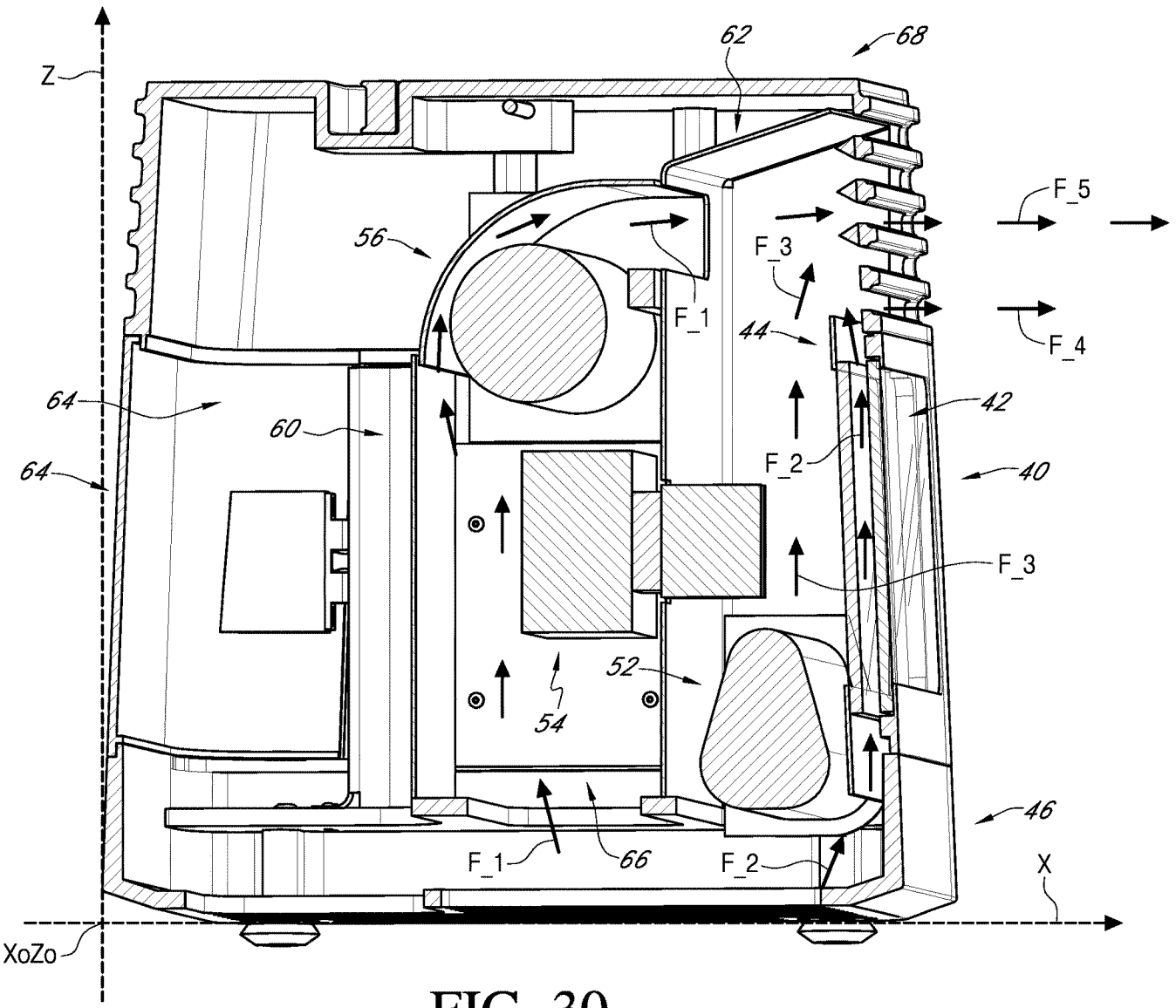
FIG. 30 is a cross-sectional side-elevational view showing aspects of the second implementation of the enhanced heating system as fully assembled including aspects of front pane frame assembly, window pane assembly, rear pane frame assembly, base assembly, burner assembly, Seebeck thermoelectric generator assembly, horizontal-axis elongated fan assembly, enclosure assembly, endwall assembly, cooler-air partitioned space, and top enclosure assembly.

Turning to FIG. 30, depicted therein is a cross-sectional side-elevational view showing aspects of the second implementation of the enhanced heating system 70 as fully assembled including aspects of front pane frame assembly 40, window pane assembly 42, rear pane frame assembly 44, base assembly 46, burner assembly 52, Seebeck thermoelectric generator assembly 54, horizontal-axis elongated fan assembly 56, enclosure assembly 62, endwall assembly 64, enclosure assembly 62, endwall assembly 64, cooler-air partitioned space 66, and top enclosure assembly 68; and depicted to use directional flow arrow F_1, directional flow arrow F_2, directional flow arrow F_3, directional flow arrow F_4, and directional flow arrow F_5. In implementations, lower intermediate gap aperture 44*e*1 and upper intermediate gap aperture 44*e*2 (e.g. see FIG. 19) can be positioned, sized, and shaped to allow for sufficient passage of air into and out of the gap space to maintain a temperature on exterior window pane 42*b* at or below 120 F while burner assembly 52 is burning fuel.

Figure 31:
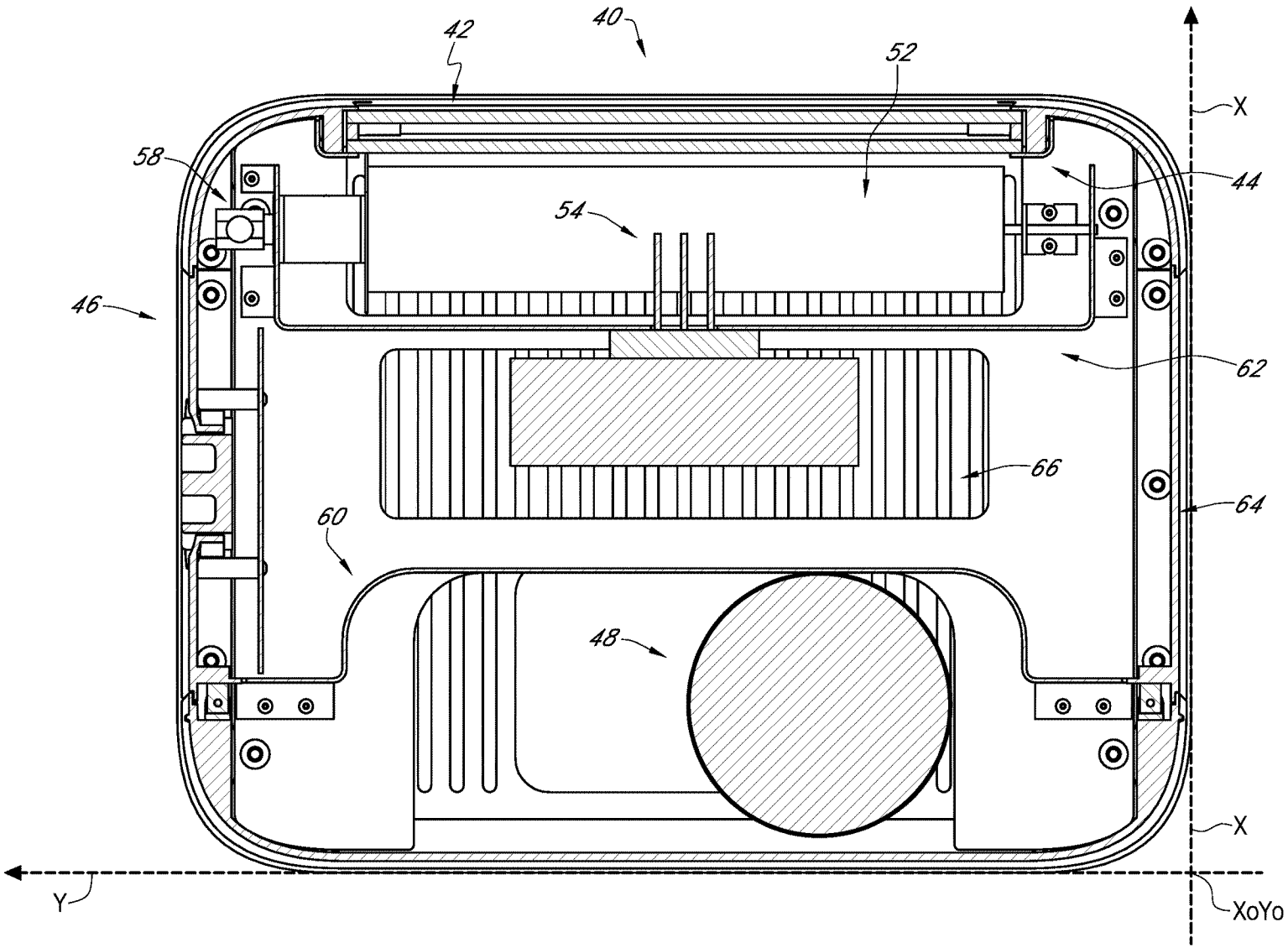
FIG. 31 is a cross-sectional top plan view showing aspects of the second implementation of the enhanced heating system including aspects of front pane frame assembly, window pane assembly, rear pane frame assembly, base assembly, gaseous fuel storage, burner assembly, Seebeck thermoelectric generator assembly, gas nozzle assembly, wall partition assembly, enclosure assembly, endwall assembly, and cooler-air partitioned space.

Turning to FIG. 31, depicted therein is a cross-sectional top plan view showing aspects of the second implementation of the enhanced heating system 70 (e.g. see, FIG. 29) including aspects of front pane frame assembly 40, window pane assembly 42, rear pane frame assembly 44, base assembly 46, gaseous fuel storage 48, burner assembly 52, Seebeck thermoelectric generator assembly 54, gas nozzle assembly 58, wall partition assembly 60, enclosure assembly 62, endwall assembly 64, and cooler-air partitioned space 66.

Both first implementation of enhanced heater system 28 and second implementation of enhanced heating system 70 can include sufficient airflow rates to project heat horizontally outward including 6 feet therefrom. Consequently limitations of conventional heaters that produce primarily vertical heating are overcome herein. Another consequence is that external window glass pane temperatures can remain below a 120 degree Fahrenheit threshold to prevent possible skin damage. Fans can be included that can produce such as 1000 cubic feet of air per minute at ambient temperature which mixes with, for instance, 25 cubic feet per minute of air heated to 500 degrees to produce desired exit temperature. Alternatively, users can also set exit temperatures so external glass pane temperature is above 120 degrees Fahrenheit with attendant greater risk. In implementations, internal volume of enhanced heater system 28 and enhanced heating system 70 can be 2000 to 3000 square inches and 200 to 300 square inches, respectively.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., " a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., " a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A system for heating, the system comprising:

(I) an enclosure;

(II) at least one burner to burn fuel to generate heat, the at least one burner positioned within the enclosure;

(III) at least one electrically-powered fan positioned within the enclosure to push out from the fan an upward-vertically-directed airstream within the enclosure;

(IV) a wall partition positioned within the enclosure, the wall partition including at least a first side and at least a second side, (a) the at least one electrically powered fan being positioned on the first side of the wall partition, and (b) the at least one burner being positioned on the second side of the wall partition; and (V) at least one thermoelectric generator to generate electrical power for the at least one electrically-powered fan, the at least one thermoelectric generator including (a) at least one cool-side heat exchanger portion being positioned on the first side of the wall partition, (b) at least one hot-side heat exchanger portion being positioned on the second side of the wall partition above the at least one burner, and (c) a thermoelectric conversion portion to generate electricity to at least in part power the at least one electrically-powered fan based at least in part upon a temperature difference between the cool-side heat exchanger portion and the hot-side heat exchanger portion, wherein the wall partition being a cylindrical structure including an and an exterior curvilinear wall surface, the first side of the wall partition being the interior curvilinear wall surface and the second side of the wall partition being the exterior curvilinear wall surface.

2. The system of claim 1 further including a multi-directional air diverter, wherein (A) the enclosure includes at least a first vertically-oriented vent portion facing in a first horizontal direction and a second vertically-oriented vent portion facing in a second horizontal direction dissimilar to the first horizontal direction, and B) the multi-directional air diverter (1) being positioned vertically above the electrically powered fan, (2) being positioned above the wall partition, (3) including a first portion being sized, positioned, and shaped to divert at least a first portion of the upward-vertically directed airstream to be outwardly-horizontally directed over the wall partition, and through the first vertically-oriented vent portion, and (4) including a second portion being sized, positioned, and shaped to divert at least a second portion of the upward-vertically directed airstream to be outwardly-horizontally directed over the wall partition, and through the second vertically-oriented vent portion.

3. The system of claim 1 further including a multi-directional airflow diverter positioned above the electrically powered fan, the multi-directional airflow diverter positioned, sized, and shaped to divert the upward-vertically-directed airstream into four horizontally-orthogonally-differently-directed airstreams.

4. The system of claim 3 wherein the multi-directional air diverter has a downward pointing pyramidal shape.

5. The system of claim 1 wherein (a) the at least one cool-side heat exchanger portion of the at least one thermoelectric generator being sized and shaped with sufficient number of fins to dissipate heat to at least one first air mass from the at least one thermoelectric generator to produce a first cooler temperature within a first portion of the at least one thermoelectric generator, (b) the at least one hot-side heat exchanger portion of the at least one thermoelectric generator being sized and shaped with sufficient number of fins to absorb heat from at least one second air mass to produce a second hotter temperature within a second portion of the thermoelectric generator, the second hotter temperature being greater than the first cooler temperature for a positive temperature difference of the first cooler temperature subtracted from the second hotter temperature, and (c) a thermoelectric conversion portion to generate electricity based upon the positive temperature difference.

6. The system of claim 1 wherein the at least one thermoelectric generator being at least one Seebeck generator.

7. The system of claim 1 wherein the burner being a ring burner, the wall partition as the cylindrical structure being encircled by the ring burner.

8. A system for heating, the system comprising:

(I) an enclosure;

(II) at least one burner to burn fuel to generate heat, the at least one burner positioned within the enclosure;

(III) at least one electrically-powered fan positioned within the enclosure to push out from the fan an upward-vertically-directed airstream within the enclosure;

(IV) a wall partition positioned within the enclosure, the wall partition including at least a first side and at least a second side, (a) the at least one electrically powered fan being positioned on the first side of the wall partition, and (b) the at least one burner being positioned on the second side of the wall partition; and (V) at least one thermoelectric generator to generate electrical power for the at least one electrically-powered fan, the at least one thermoelectric generator including (a) at least one cool-side heat exchanger portion being positioned on the first side of the wall partition, (b) at least one hot-side heat exchanger portion being positioned on the second side of the wall partition above the at least one burner, and (c) a thermoelectric conversion portion to generate electricity to at least in part power the at least one electrically-powered fan based at least in part upon a temperature difference between the cool-side heat exchanger portion and the hot-side heat exchanger portion, wherein the enclosure includes four substantially vertical sides, the four substantially vertical sides including at least one window-paned side, the at least one window-paned side including a vented-double-window-paned glass portion.

9. The system of claim 8 wherein the vented-double-window-window-paned glass portion includes an interior window pane, an exterior window pane, and a gap space therebetween, the gap space including a lower aperture positioned, sized, and shaped to allow for passage of air into the gap space and an upper aperture positioned, sized, and shaped to allow passage of air out of the gap space.

10. The system of claim 9 wherein the lower aperture and the upper aperture are positioned, sized, and shaped to allow for sufficient passage of air into and out of the gap space to maintain a temperature on the exterior surface of the exterior window pane at or below 120 F while the burner is burning fuel.

11. The system of claim 9 wherein at the enclosure includes at least one post, and at least one of the at least one window-paned side being coupled to at least one post as a door.

12. The system of claim 8 wherein the at least one window-paned side includes four window-paned sides.

13. The system of claim 8 further including an elevated-horizontally-oriented baseplate, the baseplate including at least one aperture, the baseplate supporting at least in part the enclosure wherein air is allowed to entered into the enclosure through the at least one aperture.

14. The system of claim 8 wherein the at least one cool-side heat exchanger portion of the thermoelectric generator being positioned above the at least one electrically-powered fan.

15. The system of claim 8 wherein the at least one electrically-powered fan including at least one vertical-axis fan blade.

16. The system of claim 8 wherein the fuel being propane-based fuel.

17. A system for heating, the system comprising:

(I) an enclosure having at least one vertical exhaust vent facing horizontally outward from the enclosure;

(II) at least one electrically-powered fan positioned within the enclosure to draw a first vertical airstream from the enclosure in an upward-vertical direction and to push out air from the fan in a second horizontally-directed airstream within the enclosure to be exhausted through the at least one vertical exhaust vent (III) at least one burner to burn fuel to generate heat, the at least one burner being positioned under at least a portion of the second horizontally-directed airstream;

(IV) a wall partition positioned within the enclosure, the wall partition including at least a first side and at least a second side, (a) the first vertical airstream being positioned on the first side of the wall partition, and (b) the at least one burner being positioned on the second side of the wall partition; and (V) at least one thermoelectric generator to generate electrical power for the at least one electrically-powered fan, the at least one thermoelectric generator including (a) at least one cool-side heat exchanger portion being positioned on the first side of the wall partition, (b) at least one hot-side heat exchanger portion being positioned on the second side of the wall partition above the at least one burner, and (c) a thermoelectric conversion portion to generate electricity to at least in part power the at least one electrically-powered fan based at least in part upon a positive temperature difference between the cool-side heat exchanger portion and the hot-side heat exchanger portion, wherein the at least one thermoelectric generator being at least one Seebeck generator, wherein the enclosure has a doubled-window-paned side, the burner being an elongated burner adjacently positioned along the window-paned side of the enclosure.

18. The system of claim 17 wherein (a) the at least one cool-side heat exchanger portion of the at least one thermoelectric generator being sized and shaped with sufficient number of fins to dissipate heat to at least one first air mass from the at least one thermoelectric generator to produce a first cooler temperature within a first portion of the at least one thermoelectric generator, (b) the at least one hot-side heat exchanger portion of the at least one thermoelectric generator being sized and shaped with sufficient number of fins to absorb heat from at least one second air mass to produce a second hotter temperature within a second portion of the thermoelectric generator, the second hotter temperature being greater than the first cooler temperature for a positive temperature difference of the first cooler temperature subtracted from the second hotter temperature, and (c) a thermoelectric conversion portion to generate electricity based upon the positive temperature difference.

19. A system for heating, the system comprising:

(I) an enclosure having at least one vertical exhaust vent facing horizontally outward from the enclosure;

(II) at least one electrically-powered fan positioned within the enclosure to draw a first vertical airstream from the enclosure in an upward-vertical direction and to push out air from the fan in a second horizontally-directed airstream within the enclosure to be exhausted through the at least one vertical exhaust vent;

(III) at least one burner to burn fuel to generate heat, the at least one burner being positioned under at least a portion of the second horizontally-directed airstream;

(IV) a wall partition positioned within the enclosure, the wall partition including at least a first side and at least a second side, (a) the first vertical airstream being positioned on the first side of the wall partition, and (b) the at least one burner being positioned on the second side of the wall partition; and (V) at least one thermoelectric generator to generate electrical power for the at least one electrically-powered fan, the at least one thermoelectric generator including (a) at least one cool-side heat exchanger portion being positioned on the first side of the wall partition, (b) at least one hot-side heat exchanger portion being positioned on the second side of the wall partition above the at least one burner, and (c) a thermoelectric conversion portion to generate electricity to at least in part power the at least one electrically-powered fan based at least in part upon a positive temperature difference between the cool-side heat exchanger portion and the hot-side heat exchanger portion, wherein the enclosure includes at least one window-paned side including a vented-double-window-paned glass portion being positioned under at least a portion of the second horizontally-directed airstream.

20. The system of claim 19 wherein the vented-double-window-paned glass portion includes an interior window pane, an exterior window pane, and a gap space therebetween, the gap space including a lower aperture positioned, sized, and shaped to allow for passage of air into the gap space and an upper aperture positioned, sized, and shaped to allow passage of air out of the gap space.

21. The system of claim 20 wherein the lower aperture and the upper aperture are positioned, sized, and shaped to allow for sufficient passage of air into and out of the gap space to maintain a temperature on the exterior surface of the exterior window pane at or below 120 F while the burner is burning fuel.

22. The system of claim 19 further including an elevated-horizontally-oriented baseplate, the baseplate including at least one aperture, the baseplate supporting at least in part the enclosure wherein air is allowed to entered into the enclosure through the at least one aperture.

23. A system for heating, the system comprising:

(I) an enclosure having at least one vertical exhaust vent facing horizontally outward from the enclosure;

(II) at least one electrically-powered fan positioned within the enclosure to draw a first vertical airstream from the enclosure in an upward-vertical direction and to push out air from the fan in a second horizontally-directed airstream within the enclosure to be exhausted through the at least one vertical exhaust vent (III) at least one burner to burn fuel to generate heat, the at least one burner being positioned under at least a portion of the second horizontally-directed airstream;

(IV) a wall partition positioned within the enclosure, the wall partition including at least a first side and at least a second side, (a) the first vertical airstream being positioned on the first side of the wall partition, and (b) the at least one burner being positioned on the second side of the wall partition; and (V) at least one thermoelectric generator to generate electrical power for the at least one electrically-powered fan, the at least one thermoelectric generator including (a) at least one cool-side heat exchanger portion being positioned on the first side of the wall partition, (b) at least one hot-side heat exchanger portion being positioned on the second side of the wall partition above the at least one burner, and (c) a thermoelectric conversion portion to generate electricity to at least in part power the at least one electrically-powered fan based at least in part upon a positive temperature difference between the cool-side heat exchanger portion and the hot-side heat exchanger portion, wherein the at least one cool-side heat exchanger portion of the thermoelectric generator being positioned at a level below the level of the at least one electrically-powered fan.

24. The system of claim 23 wherein the at least one electrically-powered fan including at least one horizontal-axis fan blade.

25. The system of claim 23 further comprising a propane bottle being contained within the enclosure and wherein the fuel burned by the at least one burner is propane.

* * * * *